US009599915B2

(12) United States Patent
Anezaki et al.

(10) Patent No.: US 9,599,915 B2
(45) **Date of Patent: *Mar. 21, 2017**

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takashi Anezaki, Hiratsuka (JP); Kazuhisa Shida, Kawasaki (JP); Haruyuki Tsuji, Yokohama (JP); Atsushi Fujii, Yokohama (JP); Nobuhiro Nakamura, Numazu (JP); Hiroyuki Tomono, Numazu (JP); Hideaki Matsuoka, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/629,265

(22) Filed: Feb. 23, 2015

(65) Prior Publication Data

US 2015/0241801 A1 Aug. 27, 2015

(30) Foreign Application Priority Data

Feb. 24, 2014 (JP) ..... 2014-033339
Jan. 16, 2015 (JP) ..... 2015-007041

(51) Int. Cl.
*G03G 5/14* (2006.01)
*G03G 5/087* (2006.01)
*G03G 5/08* (2006.01)

(52) U.S. Cl.
CPC ..... *G03G 5/087* (2013.01); *G03G 5/08* (2013.01); *G03G 5/14* (2013.01)

(58) Field of Classification Search
CPC ..... G03G 5/144
USPC ..... 430/63
See application file for complete search history.

(56) References Cited

U.S. PATENT DOCUMENTS

| | | | | | |
|---|---|---|---|---|---|
| 5,171,480 | A * | 12/1992 | Yoshinaka | H01B 1/20 | 252/500 |
| 5,484,694 | A * | 1/1996 | Lelental | H01B 1/20 | 423/618 |
| 5,488,461 | A * | 1/1996 | Go | G03G 5/144 | 399/159 |
| 9,372,418 | B2 * | 6/2016 | Shida | G03G 5/142 | |
| 2012/0114375 | A1 * | 5/2012 | Fujii | G03G 5/144 | 399/111 |
| 2012/0121291 | A1 * | 5/2012 | Tsuji | G03G 5/102 | 399/111 |
| 2015/0212437 | A1 * | 7/2015 | Shida | G03G 5/142 | 430/56 |

FOREIGN PATENT DOCUMENTS

| | | | |
|---|---|---|---|
| JP | H04191861 | A | 7/1992 |
| JP | H0553335 | A | 3/1993 |
| JP | 2002123028 | A | 4/2002 |
| JP | 2004349167 | A | 12/2004 |
| JP | 2010030886 | A | 2/2010 |
| JP | 2010181630 | A | 8/2010 |
| JP | 2012018370 | A | 1/2012 |
| JP | 2012018371 | A | 1/2012 |

* cited by examiner

*Primary Examiner* — Christopher Rodee
(74) *Attorney, Agent, or Firm* — Fitzpatrick, Cella, Harper & Scinto

(57) ABSTRACT

A conductive layer of an electrophotographic photosensitive member includes a binder material, a first metal oxide particle, and a second metal oxide particle. The first metal oxide particle is a zinc oxide particle or tin oxide particle coated with tin oxide doped with phosphorus, tungsten, niobium, tantalum, or fluorine. The second metal oxide particle is an uncoated zinc oxide particle or tin oxide particle. The content of the first metal oxide particle is not less than 20% by volume and not more than 50% by volume based on the total volume of the conductive layer. The content of the second metal oxide particle is not less than 0.1% by volume and not more than 15% by volume based on the total volume of the conductive layer, and not less than 0.5% by volume and not more than 30% by volume based on the content of the first metal oxide particle.

18 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including an electrophotographic photosensitive member.

Description of the Related Art

In recent years, electrophotographic photosensitive members that use an organic photoconductive material (charge generation material) have been used as electrophotographic photosensitive members included in process cartridges and electrophotographic apparatuses. Electrophotographic photosensitive members generally include a support and a photosensitive layer formed on the support.

Furthermore, a conductive layer containing conductive particles (metal oxide particles) is disposed between the support and the photosensitive layer for the purpose of covering surface defects of the support and protecting the photosensitive layer from electrical breakdown. However, the potential of the conductive layer containing metal oxide particles easily varies due to environmental changes in temperature and humidity and repeated use of electrophotographic photosensitive members. There is a technique of improving the potential characteristics by improving metal oxide particles.

Japanese Unexamined Patent Application Publication No. 4-191861 discloses a technique of incorporating two types of metal oxide particles having different average particle diameters in an undercoat layer (conductive layer). Japanese Unexamined Patent Application Publication No. 2012-18370 discloses a technique of incorporating, into a conductive layer, titanium oxide particles coated with tin oxide doped with phosphorus, tungsten, or fluorine.

However, as a result of studies conducted by the present inventors, it has been found that the electrophotographic photosensitive member described in Japanese Unexamined Patent Application Publication No. 4-191861 includes a conductive layer with a high volume resistivity, and thus the variations in a dark-area potential and a light-area potential sometimes increase in the repeated use. Furthermore, as a result of studies conducted by the present inventors, it has been found that, when a high voltage is applied to the electrophotographic photosensitive member described in Japanese Unexamined Patent Application Publication No. 2012-18370 in a low-temperature and low-humidity environment, there is still a room for suppressing the generation of leakage. Leakage is a phenomenon in which a dielectric breakdown is caused in a local portion of an electrophotographic photosensitive member, and an excessively high electric current flows in the portion. If leakage is generated, the electrophotographic photosensitive member is not sufficiently charged, which results in image defects such as black spots, horizontal white streaks, and horizontal black streaks on a formed image. The horizontal white streaks are white streaks that appear on an output image in a direction perpendicular to the rotational direction (circumferential direction) of the electrophotographic photosensitive member. The horizontal black streaks are black streaks that appear on an output image in a direction perpendicular to the rotational direction (circumferential direction) of the electrophotographic photosensitive member.

SUMMARY OF THE INVENTION

The present invention provides an electrophotographic photosensitive member in which the variations in a dark-area potential and a light-area potential in the repeated use are suppressed and the leakage is not easily generated, and a process cartridge and an electrophotographic apparatus each including the electrophotographic photosensitive member.

An electrophotographic photosensitive member according to one aspect of the present invention includes:

a support;

a conductive layer on the support; and a photosensitive layer on the conductive layer, wherein the conductive layer includes:

a binder material;

a first metal oxide particle; and a second metal oxide particle, the first metal oxide particle is a zinc oxide particle coated with tin oxide doped with phosphorus, tungsten, niobium, tantalum, or fluorine, the second metal oxide particle is an uncoated zinc oxide particle, a content of the first metal oxide particle in the conductive layer is not less than 20% by volume and not more than 50% by volume based on a total volume of the conductive layer, and a content of the second metal oxide particle in the conductive layer is not less than 0.1% by volume and not more than 15% by volume based on the total volume of the conductive layer, and not less than 0.5% by volume and not more than 30% by volume based on the content of the first metal oxide particle in the conductive layer.

An electrophotographic photosensitive member according to another aspect of the present invention includes:

a support;

a conductive layer on the support; and a photosensitive layer on the conductive layer, wherein the conductive layer includes:

a binder material;

a first metal oxide particle; and a second metal oxide particle, the first metal oxide particle is a tin oxide particle coated with tin oxide doped with phosphorus, tungsten, niobium, tantalum, or fluorine, the second metal oxide particle is an uncoated tin oxide particle, a content of the first metal oxide particle in the conductive layer is not less than 20% by volume and not more than 50% by volume based on a total volume of the conductive layer, and a content of the second metal oxide particle in the conductive layer is not less than 0.1% by volume and not more than 15% by volume based on the total volume of the conductive layer, and not less than 0.5% by volume and not more than 30% by volume based on the content of the first metal oxide particle in the conductive layer.

A process cartridge according to another aspect of the present invention is detachably attachable to a main body of an electrophotographic apparatus, wherein the process cartridge integrally supports the electrophotographic photosensitive member and at least one selected from the group consisting of a charging device, a developing device, a transfer device, and a cleaning member.

An electrophotographic apparatus according to another aspect of the present invention includes the electrophotographic photosensitive member, a charging device, an exposing device, a developing device, and a transfer device.

According to the present invention, there can be provided an electrophotographic photosensitive member in which the variations in a dark-area potential and a light-area potential in the repeated use are suppressed and the leakage is not easily generated, and a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
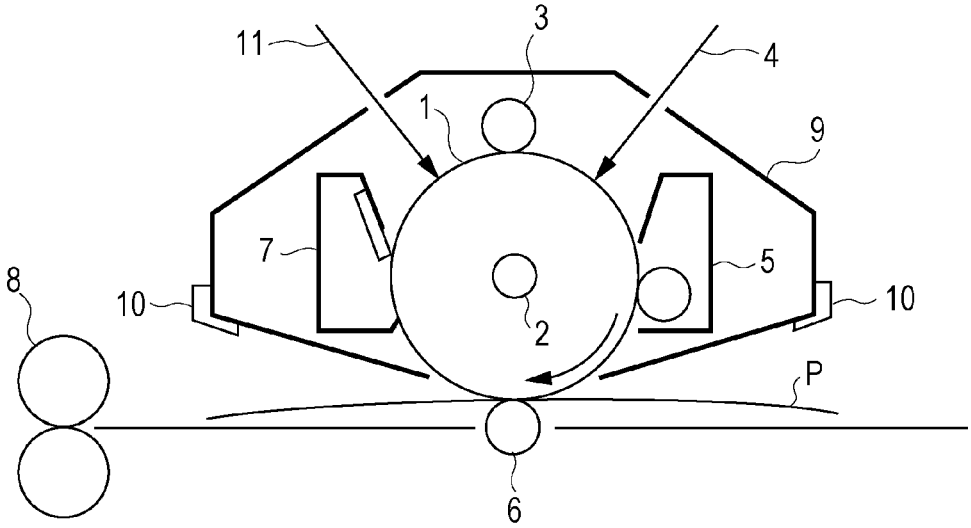
FIG. 1 illustrates an example of a schematic structure of an electrophotographic apparatus that includes a process cartridge including an electrophotographic photosensitive member.

The electrophotographic photosensitive member according to an embodiment of the present invention is an electrophotographic photosensitive member including a support, a conductive layer formed on the support, and a photosensitive layer formed on the conductive layer.

The photosensitive layer is classified into a single-layer type photosensitive layer in which a charge generation material and a charge transport material are contained in a single layer and a multilayer type photosensitive layer in which a charge generating layer containing a charge generation material and a charge transporting layer containing a charge transport material are stacked. In an embodiment of the present invention, a multilayer type photosensitive layer can be used. If necessary, an undercoat layer may be disposed between the conductive layer and the photosensitive layer.

Support

A support having conductivity (conductive support) can be used. For example, a metal support formed of a metal such as aluminum, an aluminum alloy, or stainless steel can be used. When aluminum or an aluminum alloy is used, an aluminum tube produced by a method including extrusion and drawing or an aluminum tube produced by a method including extrusion and ironing can be used.

Conductive Layer

In an embodiment of the present invention, a conductive layer is disposed on the support in order to cover surface defects of the support. The conductive layer contains a binder material, a first metal oxide particle, and a second metal oxide particle.

The first metal oxide particle is a zinc oxide particle coated with tin oxide doped with phosphorus, tungsten, niobium, tantalum, or fluorine or a tin oxide particle coated with tin oxide doped with phosphorus, tungsten, niobium, tantalum, or fluorine.

Specifically, the first metal oxide particle is a zinc oxide (ZnO) particle or a tin oxide ($SnO_2$) particle coated with tin oxide ($SnO_2$) doped with phosphorus (P), a zinc oxide (ZnO) particle or a tin oxide ($SnO_2$) particle coated with tin oxide ($SnO_2$) doped with tungsten (W), a zinc oxide (ZnO) particle or a tin oxide ($SnO_2$) particle coated with tin oxide ($SnO_2$) doped with niobium (Nb), a zinc oxide (ZnO) particle or a tin oxide ($SnO_2$) particle coated with tin oxide ($SnO_2$) doped with tantalum (Ta), or a zinc oxide (ZnO) particle or a tin oxide ($SnO_2$) particle coated with tin oxide ($SnO_2$) doped with fluorine (F). They may be collectively referred to as a "P/W/Nb/Ta/F-doped tin oxide-coated zinc oxide particle or tin oxide particle".

The second metal oxide particle is an uncoated zinc oxide particle or an uncoated tin oxide particle. The uncoated zinc oxide particle is a zinc oxide particle which is not coated with an inorganic material such as tin oxide or aluminum oxide and also is not coated (surface-treated) with an organic material such as a silane coupling agent. The uncoated tin oxide particle is a tin oxide particle which is not coated with an inorganic material such as tin oxide or aluminum oxide and also is not coated (surface-treated) with an organic material such as a silane coupling agent. Furthermore, the uncoated zinc oxide particle and the uncoated tin oxide particle are desirably not doped with phosphorus, tungsten, niobium, tantalum, or fluorine. Hereafter, they may be collectively referred to as an "uncoated zinc oxide particle or tin oxide particle".

The P/W/Nb/Ta/F-doped tin oxide-coated zinc oxide particle or tin oxide particle used as the first metal oxide particle is contained in the conductive layer in an amount of 20% by volume or more and 50% by volume or less based on the total volume of the conductive layer.

The uncoated zinc oxide particle or tin oxide particle used as the second metal oxide particle is contained in the conductive layer in an amount of 0.1% by volume or more and 15% by volume or less based on the total volume of the conductive layer. Furthermore, the content of the second metal oxide particle in the conductive layer is 0.5% by volume or more and 30% by volume or less based on the content of the first metal oxide particle in the conductive layer. The content is particularly 1% by volume or more and 20% by volume or less.

If the content of the first metal oxide particle in the conductive layer is less than 20% by volume based on the total volume of the conductive layer, the distance between the first metal oxide particles tends to increase. As the distance between the first metal oxide particles increases, the volume resistivity of the conductive layer increases. This tends to prevent the smooth flow of charges during the image formation, increase the residual potential, and cause a dark-area potential and a light-area potential to vary.

If the content of the first metal oxide particle in the conductive layer is more than 50% by volume based on the total volume of the conductive layer, the first metal oxide particles tend to come close to each other. A portion in which the first metal oxide particle is in contact with each other is a portion in which the volume resistivity of the conductive layer is locally low. As a result, leakage easily occurs in the electrophotographic photosensitive member.

A surface of an inorganic pigment particle (zinc oxide particle or tin oxide particle) can be coated with P/W/Nb/Ta/F-doped tin oxide by the method disclosed in Japanese Unexamined Patent Application Publication No. 2004-349167. The tin oxide particle coated with tin oxide ($SnO_2$) can be produced by the method disclosed in Japanese Unexamined Patent Application Publication No. 2010-30886.

Compared with the first metal oxide particle, an uncoated zinc oxide particle or a tin oxide particle serving as the second metal oxide particle is believed to have a function of suppressing the leakage generated when a high voltage is applied to an electrophotographic photosensitive member in a low-temperature and low-humidity environment.

It is generally considered that charges flowing through the conductive layer mainly flow along a surface of the first metal oxide particle having a powder resistivity lower than that of the second metal oxide particle. If the second metal oxide particle is not used, it is considered that charges are concentrated in a portion in which the ratio of the first metal oxide particle in the conductive layer is large when a high voltage is applied to the electrophotographic photosensitive member, and thus leakage easily occurs in the electrophotographic photosensitive member.

The first metal oxide particle and the second metal oxide particle have conductivity higher than that of a nonconductive binder material. In the case where the second metal oxide particle having a powder resistivity higher than that of the first metal oxide particle is added to the conductive layer, it is believed that only when an excessively large amount of charges flows through the conductive layer, charges flow along the surface of the second metal oxide particle in addition to the surface of the first metal oxide particle. When a high voltage is applied to the electrophotographic photosensitive member and an excessively large amount of charges flows through the conductive layer, charges flow along the surface of the second metal oxide particle. As a result, it is believed that charges more uniformly flow through the conductive layer, and thus the generation of leakage is suppressed.

If the content of the second metal oxide particle (uncoated zinc oxide particle or tin oxide particle) in the conductive layer is less than 0.1% by volume based on the total volume of the conductive layer, only a small effect achieved by adding the second metal oxide particle to the conductive layer is produced.

If the content of the second metal oxide particle in the conductive layer is more than 20% by volume based on the total volume of the conductive layer, the volume resistivity of the conductive layer tends to increase. This tends to prevent the smooth flow of charges during the image formation, increase the residual potential, and cause a dark-area potential and a light-area potential to vary.

If the content of the second metal oxide particle in the conductive layer is less than 0.5% by volume based on the content of the first metal oxide particle, only a small effect achieved by adding the second metal oxide particle to the conductive layer is produced.

If the content of the second metal oxide particle in the conductive layer is more than 30% by volume based on the content of the first metal oxide particle, the volume resistivity of the conductive layer tends to increase. This tends to prevent the smooth flow of charges during the image formation, increase the residual potential, and cause a dark-area potential and a light-area potential to vary.

The shape of the zinc oxide particle or the tin oxide particle serving as a core particle in the first metal oxide particle and the shape of the second metal oxide particle may be a particulate shape, a spherical shape, a needle-like shape, a fibrous shape, a columnar shape, a rod-like shape, a spindle shape, a plate-like shape, or another shape similar to the foregoing. Among them, a spherical shape is particularly employed because formation of image defects such as black spots is suppressed.

The volume-average particle diameter ($D_1$) of the first metal oxide particle in the conductive layer is preferably 0.10 μm or more and 0.45 μm or less and more preferably 0.15 μm or more and 0.40 μm or less.

If the volume-average particle diameter of the first metal oxide particle is 0.10 μm or more, reaggregation of the first metal oxide particle after a conductive layer-forming coating solution is prepared is further suppressed. If the reaggregation of the first metal oxide particle occurs, the stability of the conductive layer-forming coating solution decreases and cracks are easily formed on the surface of a conductive layer to be formed.

When the volume-average particle diameter of the first metal oxide particle is 0.45 μm or less, the surface of the conductive layer is not easily roughened, which leads to favorable results. If the surface of the conductive layer is roughened, the local injection of charges into the photosensitive layer tends to occur, and thus black spots on a white background of an output image are clearly observed.

The ratio ($D_1/D_2$) of the volume-average particle diameter ($D_1$) of the first metal oxide particle to the volume-average particle diameter ($D_2$) of the second metal oxide particle in the conductive layer is preferably 0.7 or more and 1.5 or less and more preferably 1.0 or more and 1.5 or less.

When the ratio ($D_1/D_2$) is 0.7 or more, the volume-average particle diameter of the second metal oxide particle is not excessively large compared with the volume-average particle diameter of the first metal oxide particle. Thus, the variations in a dark-area potential and a light-area potential are suppressed. When the ratio ($D_1/D_2$) is 1.5 or less, the volume-average particle diameter of the second metal oxide particle is not excessively small compared with the volume-average particle diameter of the first metal oxide particle. Thus, the leakage is further suppressed.

In an embodiment of the present invention, the content and volume-average particle diameter of the first metal oxide particle and the second metal oxide particle in the conductive layer can be determined from a three-dimensional structure analysis obtained from the elemental mapping that uses FIB-SEM and the Slice & View of FIB-SEM.

The ratio (coating ratio) of tin oxide ($SnO_2$) that coats the first metal oxide particle can be 10 to 60 mass % based on the first metal oxide particle. To control the coating ratio of the tin oxide, a tin raw material required to generate tin oxide can be added in the production of the first metal oxide particle. When, for example, tin chloride ($SnCl_4$) serving as a tin raw material is used, the amount of tin chloride added is determined in consideration of the coating ratio of tin oxide generated from the tin chloride ($SnCl_4$). In an embodiment of the present invention, the coating ratio of the tin oxide of the first metal oxide particle is determined without taking into account the mass of phosphorus, tungsten, fluorine, niobium, or tantalum with which the tin oxide is doped.

The powder resistivity of the first metal oxide particle is preferably $1.0\times10^1$ Ω·cm or more and $1.0\times10^6$ Ω·cm or less and more preferably $1.0\times10^2$ Ω·cm or more and $1.0\times10^6$ Ω·cm or less.

The powder resistivity of the second metal oxide particle is preferably $1.0\times10^0$ Ω·cm or more and $1.0\times10^5$ Ω·cm or less and more preferably $1.0\times10^1$ Ω·cm or more and $1.0\times10^4$ Ω·cm or less.

The amount (doping ratio) of phosphorus, tungsten, fluorine, niobium, or tantalum with which the tin oxide in the first metal oxide particle is doped can be 0.1 to 10 mass % based on the tin oxide. In this case, the mass of the tin oxide is a mass of tin oxide not containing phosphorus, tungsten, fluorine, niobium, or tantalum.

The volume resistivity of the conductive layer can be $1.0\times10^{8}$ Ω·cm or more and $5.0\times10^{12}$ Ω·cm or less. When the volume resistivity of the conductive layer is $5.0\times10^{12}$ Ω·cm or less, charges smoothly flow and an increase in the residual potential is suppressed. When the volume resistivity of the conductive layer is $1.0\times10^{8}$ Ω·cm or more, the amount of charges that flow in the conductive layer is favorably adjusted when the electrophotographic photosensitive member is charged.

Figure 3:
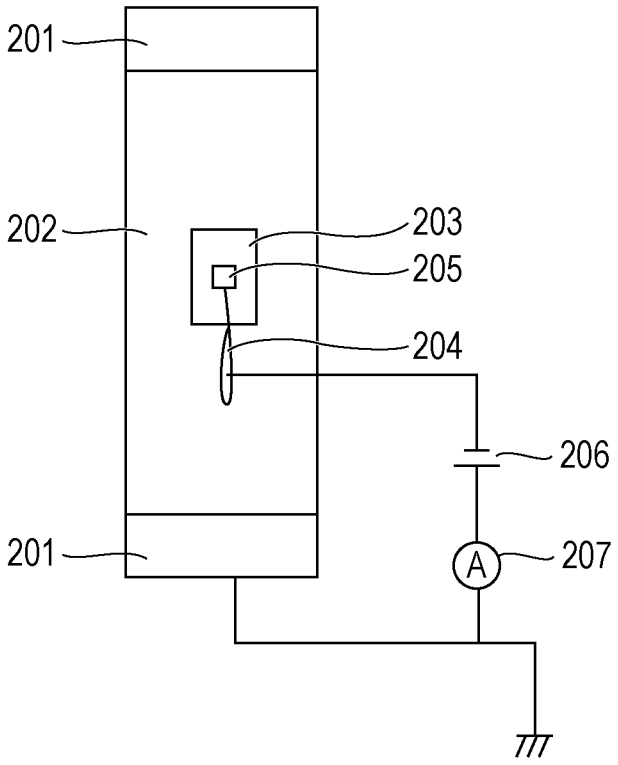
FIG. 3 is a top view for describing a method for measuring the volume resistivity of a conductive layer.
Figure 4:
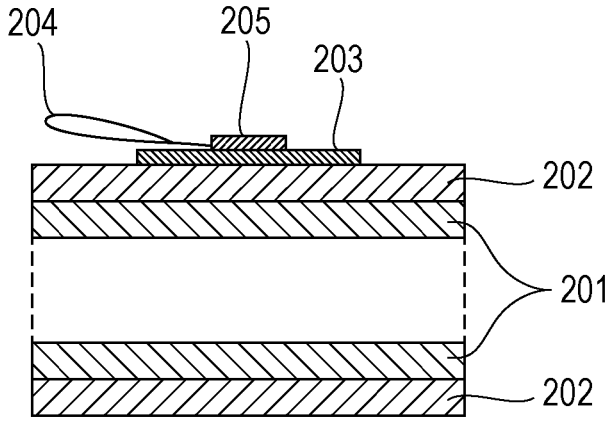
FIG. 4 is a sectional view for describing a method for measuring the volume resistivity of a conductive layer.
Figure 5:
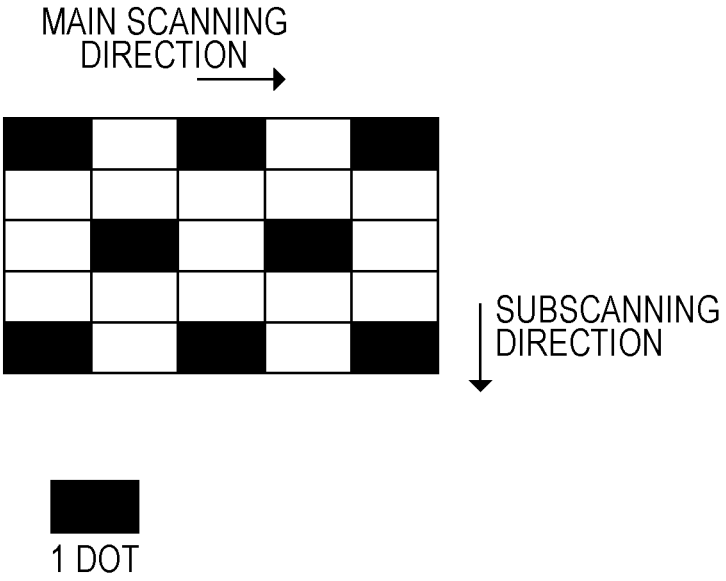
FIG. 5 is a diagram for describing a similar knight jump pattern image.

A method for measuring the volume resistivity of the conductive layer will be described with reference to FIGS. 3 and 4. FIG. 3 is a top view for describing the method for measuring the volume resistivity of the conductive layer. FIG. 4 is a sectional view for describing the method for measuring the volume resistivity of the conductive layer.

The volume resistivity of the conductive layer is measured in an ordinary-temperature and ordinary-humidity environment (23° C./50% RH). A copper tape 203 (Model No. 1181 manufactured by Sumitomo 3M Limited) is attached to the surface of a conductive layer 202, and the copper tape 203 is treated as a front side electrode of the conductive layer 202. A support 201 is treated as a back side electrode of the conductive layer 202. A power supply 206 for applying a voltage between the copper tape 203 and the support 201 and an ammeter 207 for measuring an electric current that flows between the copper tape 203 and the support 201 are provided. A copper wire 204 is placed on the copper tape 203 to apply a voltage to the copper tape 203. A copper tape 205, which is the same as the copper tape 203, is attached onto the copper wire 204 so that the copper wire 204 does not lie outside the copper tape 203. Thus, the copper wire 204 is fixed. A voltage is applied to the copper tape 203 through the copper wire 204.

A value obtained from formula (1) below is defined as a volume resistivity ρ (Ω·cm) of the conductive layer 202.

$$\rho=1/(I-I_0)\times S/d(\Omega\cdot cm) \quad (1)$$

In the formula, $I_0$ represents a background current value (A) when a voltage is not applied between the copper tape 203 and the support 201; I represents a current value (A) when only a direct-current voltage (direct-current component) of −1 V is applied; d represents a thickness (cm) of the conductive layer 202; and S represents an area ($cm^2$) of the front side electrode (copper tape 203) of the conductive layer 202.

In this measurement, a very small current value of $1\times10^{-6}$ A or less expressed in terms of absolute value is measured. Therefore, the ammeter 207 is a device capable of measuring minute current. Examples of the device include a pA meter (trade name: 4140B) manufactured by Yokogawa Hewlett-Packard and a high resistance meter (trade name: 4339B) manufactured by Agilent Technologies.

The volume resistivity of the conductive layer measured in a structure in which only the conductive layer is formed on the support is equal to the volume resistivity measured in a structure in which layers (e.g., photosensitive layer) on the conductive layer are removed from the electrophotographic photosensitive member and only the conductive layer is left on the support.

The powder resistivity of the first metal oxide particle is measured as follows.

The powder resistivities of the first metal oxide particle and the second metal oxide particle are measured in an ordinary-temperature and ordinary-humidity environment (23° C./50% RH). In an embodiment of the present invention, the measurement instrument is a resistivity meter (trade name: Loresta GP) manufactured by Mitsubishi Chemical Corporation. The first metal oxide particle and second metal oxide particle to be measured are formed into a pellet-shaped measurement sample by being solidified at a pressure of 500 $kg/cm^2$. The application voltage is 100 V.

The conductive layer can be formed by applying a conductive layer-forming coating solution containing a solvent, a binder material, the first metal oxide particle, and the second metal oxide particle onto a support to form a coating film and then drying and/or curing the resulting coating film.

The conductive layer-forming coating solution can be prepared by dispersing the first metal oxide particle, the second metal oxide particle, and a binder material in a solvent. The dispersion may be performed with a paint shaker, a sand mill, a ball mill, or a liquid collision high speed disperser.

Examples of the binder material used in the conductive layer include phenolic resin, polyurethane, polyamide, polyimide, polyamide-imide, polyvinyl acetal, epoxy resin, acrylic resin, melamine resin, and polyester. These binder materials may be used alone or in combination of two or more. Among these resins, a curable resin is preferably used and a heat-curable resin is more preferably used to suppress the migration (penetration) into other layers, increase the adhesiveness to the support, and improve the dispersibility and dispersion stability of the first metal oxide particle and the second metal oxide particle. Among the heat-curable resins, a heat-curable phenolic resin or a heat-curable polyurethane is particularly used. When the curable resin is used as a binder material for the conductive layer, the binder material contained in the conductive layer-forming coating solution is a monomer and/or an oligomer of the curable resin.

Examples of the solvent used in the conductive layer-forming coating solution include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

The thickness of the conductive layer is preferably 10 μm or more and 40 μm or less and more preferably 15 μm or more and 35 μm or less to cover the surface defects of the support.

The thickness of each layer of the electrophotographic photosensitive member including the conductive layer is measured with FISHERSCOPE MMS manufactured by Fischer Instruments K.K.

The conductive layer may contain a surface roughening material to suppress the generation of interference fringes on an output image due to the interference of light reflected at the surface of the conductive layer. The surface roughening material is, for example, resin particles having an average particle diameter of 1 μm or more and 5 μm or less. Examples of the resin particles include particles of curable resins such as curable rubber, polyurethane, epoxy resin, alkyd resin, phenolic resin, polyester, silicone resin, and acrylic-melamine resin. Among them, particles of silicone resin are particularly used because they are not easily aggregated. The density (0.5 to 2 $g/cm^3$) of the resin particle is lower than the densities (5 to 8 $g/cm^3$) of the first metal oxide particle. Therefore, the surface of the conductive layer can be efficiently roughened when the conductive layer is formed. The content of the surface roughening material in the conductive layer can be 1 to 80 mass % based on the binder material in the conductive layer.

The densities (g/cm$^3$) of the first metal oxide particle, the second metal oxide particle, the binder material (if the binder material is liquid, the binder material is cured and then the density is measured), and the silicone particles are determined as follows using a dry-process automatic densitometer (trade name: Accupyc 1330) manufactured by SHIMADZU CORPORATION. The densities are measured at 23° C. with a container having a volume of 10 cm$^3$. The pretreatment of particles to be measured is helium gas purge performed ten times at a maximum pressure of 19.5 psig. Subsequently, whether the pressure in the container reaches equilibrium is determined. When the fluctuation of the pressure in the chamber is 0.0050 psig/min or less, an equilibrium state is considered to be achieved and the density (g/cm$^3$) is automatically measured. The density of the first metal oxide particle can be adjusted with, for example, doping species of the tin oxide.

The density of the second metal oxide particle can also be adjusted by controlling the crystal form and the mixing ratio. The conductive layer may also contain a leveling agent for improving the surface properties of the conductive layer.

Undercoat Layer

An undercoat layer having electrical barrier properties may be disposed between the conductive layer and the photosensitive layer to prevent charges from being injected into the photosensitive layer from the conductive layer.

The undercoat layer can be formed by applying an undercoat layer-forming coating solution containing a resin (binder resin) onto the conductive layer to form a coating film and then drying the resulting coating film.

Examples of the resin (binder resin) used for the undercoat layer include polyvinyl alcohol, polyvinyl methyl ether, polyacrylic acid, methyl cellulose, ethyl cellulose, polyglutamic acid, casein, polyamide, polyimide, polyamide-imide, polyamic acid, melamine resin, epoxy resin, polyurethane, and polyglutamic acid ester. Among them, a heat-curable resin is particularly used. Among the heat-curable resins, a heat-curable polyamide is particularly used. The polyamide is, for example, a copolymer nylon.

The thickness of the undercoat layer can be 0.1 μm or more and 2 μm or less. The undercoat layer may contain an electron transport material (electron accepting material such as acceptor) to cause charges to smoothly flow in the undercoat layer.

Examples of the electron transport material include electron withdrawing materials such as 2,4,7-trinitrofluorenone, 2,4,5,7-tetranitrofluorenone, chloranil, and tetracyanoquinodimethane; and materials obtained by polymerizing the electron withdrawing materials.

Photosensitive Layer

A photosensitive layer is disposed on the conductive layer or the undercoat layer.

Examples of the charge generation material used for the photosensitive layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, xanthene dyes, quinoneimine dyes, and styryl dyes. Among them, metal phthalocyanines such as oxytitanium phthalocyanine, hydroxygallium phthalocyanine, and chlorogallium phthalocyanine are particularly used.

When the photosensitive layer is a multilayer type photosensitive layer, the charge generating layer can be formed by applying a charge generating layer-forming coating solution prepared by dispersing a charge generation material and a binder resin in a solvent to form a coating film and then drying the resulting coating film. The dispersion is performed with, for example, a homogenizer, an ultrasonic disperser, a ball mill, a sand mill, an attritor, or a roll mill.

Examples of the binder resin used for the charge generating layer include polycarbonate, polyester, polyarylate, butyral resin, polystyrene, polyvinyl acetal, diallyl phthalate resin, acrylic resin, methacrylic resin, vinyl acetate resin, phenolic resin, silicone resin, polysulfone, styrene-butadiene copolymers, alkyd resin, epoxy resin, urea resin, and vinyl chloride-vinyl acetate copolymers. These resins may be used alone or in combination of two or more as a mixture or a copolymer.

The mass ratio of the charge generation material and the binder resin (charge generation material:binder resin) is preferably in the range of 10:1 to 1:10 and more preferably in the range of 5:1 to 1:1.

Examples of the solvent used for the charge generating layer-forming coating solution include alcohols, sulfoxides, ketones, ethers, esters, halogenated aliphatic hydrocarbons, and aromatic compounds.

The thickness of the charge generating layer is preferably 5 μm or less and more preferably 0.1 μm or more and 2 μm or less.

The charge generating layer may optionally contain various additive agents such as a sensitizer, an antioxidant, an ultraviolet absorber, and a plasticizer. The charge generating layer may also contain an electron transport material (electron accepting material such as acceptor) to cause charges to smoothly flow in the charge generating layer.

Examples of the charge transport material used for the photosensitive layer include triarylamine compounds, hydrazone compounds, styryl compounds, stilbene compounds, pyrazoline compounds, oxazole compounds, thiazole compounds, and triallylmethane compounds.

When the photosensitive layer is a multilayer type photosensitive layer, the charge transporting layer can be formed by applying a charge transporting layer-forming coating solution prepared by dissolving a charge transport material and a binder resin in a solvent to form a coating film and then drying the resulting coating film.

Examples of the binder resin used for the charge transporting layer include acrylic resin, styrene resin, polyester, polycarbonate, polyarylate, polysulfone, polyphenylene oxide, epoxy resin, polyurethane, and alkyd resin. These resins may be used alone or in combination of two or more as a mixture or a copolymer.

The mass ratio of the charge transport material and the binder resin (charge transport material:binder resin) can be in the range of 2:1 to 1:2.

Examples of the solvent used for the charge transporting layer-forming coating solution include ketone solvents, ester solvents, ether solvents, aromatic hydrocarbon solvents, and hydrocarbon solvents substituted with a halogen atom.

The thickness of the charge transporting layer is preferably 3 μm or more and 40 μm or less and more preferably 4 μm or more and 30 μm or less.

The charge transporting layer may optionally contain an antioxidant, an ultraviolet absorber, and a plasticizer.

When the photosensitive layer is a single-layer type photosensitive layer, the single-layer type photosensitive layer can be formed by applying a single-layer type photosensitive layer-forming coating solution containing a charge generation material, a charge transport material, a binder resin, and a solvent to form a coating film and then drying the resulting coating film. The charge generation material, the charge transport material, the binder resin, and the solvent may be those described above.

A protective layer may be disposed on the photosensitive layer to protect the photosensitive layer.

The protective layer can be formed by applying a protective layer-forming coating solution containing a resin (binder resin) and then drying and/or curing the resulting coating film.

The thickness of the protective layer is preferably 0.5 μm or more and 10 μm or less and more preferably 1 μm or more and 8 μm or less.

The coating solution for each of the layers can be applied by dipping (dip coating), spray coating, spinner coating, roller coating, Meyer bar coating, blade coating, or the like.

FIG. 1 illustrates an example of a schematic structure of an electrophotographic apparatus that includes a process cartridge including an electrophotographic photosensitive member.

In FIG. 1, a drum-shaped (cylindrical) electrophotographic photosensitive member 1 is rotated about a shaft 2 at a predetermined peripheral speed in a direction indicated by an arrow.

The surface (peripheral surface) of the rotated electrophotographic photosensitive member 1 is uniformly charged at a predetermined positive or negative potential by a charging device (first charging device such as a charging roller) 3. The electrophotographic photosensitive member 1 is then irradiated with exposure light (image exposure light) 4 emitted from an exposing device (not illustrated) such as a slit exposing device or a laser beam scanning exposing device. Thus, electrostatic latent images corresponding to intended images are successively formed on the peripheral surface of the electrophotographic photosensitive member 1. The voltage applied to the charging device 3 may be only a direct-current voltage or a direct-current voltage obtained by superimposing an alternating voltage.

The electrostatic latent images formed on the peripheral surface of the electrophotographic photosensitive member 1 are subjected to development with a toner contained in a developing device 5 and are made visible as toner images. The toner images formed on the peripheral surface of the electrophotographic photosensitive member 1 are then transferred onto a transfer material (e.g., paper) P by a transfer bias from a transfer device (e.g., transfer roller) 6. The transfer material P is fed to a portion (contact portion) between the electrophotographic photosensitive member 1 and the transfer device 6 from a transfer material feeding device (not illustrated) in synchronism with the rotation of the electrophotographic photosensitive member 1.

The transfer material P onto which toner images have been transferred is separated from the peripheral surface of the electrophotographic photosensitive member 1 and is conveyed to a fixing device 8. After the toner images are fixed, the transfer material P is output from the electrophotographic apparatus as an image-formed article (such as a print or a copy).

The peripheral surface of the electrophotographic photosensitive member 1 after the toner images have been transferred is cleaned by removing an untransferred residual toner with a cleaning member (e.g., cleaning blade) 7. The electricity on the peripheral surface of the electrophotographic photosensitive member 1 is removed with pre-exposure light 11 from a pre-exposing device (not illustrated), and then the electrophotographic photosensitive member 1 is repeatedly used for image forming. In the case where the charging device is a contact charging device such as a charging roller, pre-exposure is not necessarily required.

The electrophotographic photosensitive member 1 and at least one component selected from the charging device 3, the developing device 5, the transfer device 6, and the cleaning member 7 may be incorporated in a container and integrally supported to provide a process cartridge. The process cartridge may be detachably attachable to the main body of an electrophotographic apparatus. In FIG. 1, the electrophotographic photosensitive member 1 and the charging device 3, the developing device 5, and the cleaning member 7 are integrally supported to provide a process cartridge 9, which is detachably attachable to the main body of an electrophotographic apparatus using a guide unit 10 such as a rail of the main body. The electrophotographic apparatus may include the electrophotographic photosensitive member 1 and the charging device 3, the exposing device, the developing device 5, and the transfer device 6.

EXAMPLES

Hereafter, the present invention will be further described in detail based on specific Examples, but is not limited thereto. In Examples and Comparative Examples, "part" means "part by mass". In Examples and Comparative Examples, the particle size distribution of each type of particles had one peak.

Preparation Examples of Conductive Layer-Forming Coating Solutions

Preparation Example of Conductive Layer-Forming Coating Solution 1

Into a sand mill, 150 parts of zinc oxide particles coated with tin oxide doped with phosphorus (powder resistivity: $5.0\times10^2$ Ω·cm, volume-average particle diameter: 0.20 μm, powder resistivity of core particles (zinc oxide particles): $5.0\times10^7$ Ω·cm, volume-average particle diameter of core particles (zinc oxide particles): 0.18 μm, density: 5.61 g/cm$^3$) serving as first metal oxide particles, 10 parts of uncoated zinc oxide particles (powder resistivity: $5.0\times10^7$ Ω·cm, volume-average particle diameter: 0.20 μm, density: 5.61 g/cm$^3$) serving as second metal oxide particles, 168 parts of phenolic resin (monomer/oligomer of phenolic resin) (trade name: Plyophen J-325 manufactured by DIC Corporation, resin solid content: 60%, density after curing: 1.3 g/cm$^3$) serving as a binder material, and 98 parts of 1-methoxy-2-propanol serving as a solvent were inserted together with 420 parts of glass beads having a diameter of 0.8 mm. A dispersion treatment was performed at a rotational speed of 1500 rpm for a dispersion treatment time of 4 hours to obtain a dispersion liquid.

The glass beads were removed from the dispersion liquid with a mesh. Then, 13.8 parts of silicone resin particles (trade name: Tospearl 120 manufactured by Momentive Performance Materials Inc., average particle diameter: 2 μm, density: 1.3 g/cm$^3$) serving as a surface roughening material were added to the resulting dispersion liquid. Furthermore, 0.014 parts of silicone oil (trade name: SH28PA manufactured by Dow Corning Toray Co., Ltd.) serving as a leveling agent, 6 parts of methanol, and 6 parts of 1-methoxy-2-propanol were added to the dispersion liquid, and stirring was performed to prepare a conductive layer-forming coating solution 1.

Preparation Examples of Conductive Layer-Forming Coating Solutions 2 to 100, C1 to C37, and C43 to C77

The type, volume-average particle diameter, and amount (number of parts) of the first metal oxide particles and the second metal oxide particles used in the preparation of the conductive layer-forming coating solution were changed to those listed in Tables 1 to 5. Except for the above changes, conductive layer-forming coating solutions 2 to 100, C1 to C37, and C43 to C77 were prepared in the same manner as in Preparation Example of the conductive layer-forming coating solution 1. In the preparation of the conductive layer-forming coating solutions 18 and 84, the rotational speed was changed to 2500 rpm, and the dispersion treatment time was changed to 30 hours.

TABLE 1

Table 1

| | First metal oxide particles | | | | Second metal oxide particles (uncoated zinc oxide particles) | | Binder material (B) (phenolic resin) |
|---|---|---|---|---|---|---|---|
| Conductive layer-forming coating solution | Type | Powder resistivity [Ω · cm] | Volume-average particle diameter [μm] | Amount [part] | Volume-average particle diameter [μm] | Amount [part] | Amount [part] (resin solid content is 60 mass % of the following value) |
| 1 | Zinc oxide particles | $5.0 \times 10^2$ | 0.20 | 150 | 0.20 | 10 | 168 |
| 2 | coated with tin oxide | $5.0 \times 10^2$ | 0.20 | 150 | 0.20 | 28 | 168 |
| 3 | doped with | $5.0 \times 10^2$ | 0.20 | 150 | 0.20 | 38 | 168 |
| 4 | phosphorus | $5.0 \times 10^2$ | 0.20 | 290 | 0.20 | 2 | 168 |
| 5 | Density: 6.1 g/cm$^3$ | $5.0 \times 10^2$ | 0.20 | 290 | 0.20 | 23 | 168 |
| 6 | | $5.0 \times 10^2$ | 0.20 | 560 | 0.20 | 51 | 168 |
| 7 | | $5.0 \times 10^2$ | 0.20 | 560 | 0.20 | 26 | 168 |
| 8 | | $5.0 \times 10^2$ | 0.20 | 290 | 0.20 | 38 | 168 |
| 9 | | $5.0 \times 10^2$ | 0.20 | 290 | 0.20 | 69 | 168 |
| 10 | | $5.0 \times 10^2$ | 0.20 | 560 | 0.20 | 102 | 168 |
| 11 | | $5.0 \times 10^2$ | 0.20 | 560 | 0.20 | 151 | 168 |
| 12 | | $5.0 \times 10^2$ | 0.45 | 290 | 0.20 | 14 | 168 |
| 13 | | $5.0 \times 10^2$ | 0.45 | 290 | 0.40 | 14 | 168 |
| 14 | | $5.0 \times 10^2$ | 0.15 | 290 | 0.15 | 14 | 168 |
| 15 | | $5.0 \times 10^2$ | 0.15 | 290 | 0.10 | 14 | 168 |
| 16 | | $2.0 \times 10^2$ | 0.20 | 290 | 0.20 | 23 | 168 |
| 17 | | $1.5 \times 10^3$ | 0.20 | 290 | 0.20 | 23 | 168 |
| 18 | | $5.0 \times 10^2$ | 0.20 | 160 | 0.20 | 12 | 168 |
| 19 | Zinc oxide particles | $5.0 \times 10^2$ | 0.20 | 150 | 0.20 | 10 | 168 |
| 20 | coated with tin oxide | $5.0 \times 10^2$ | 0.20 | 300 | 0.20 | 14 | 168 |
| 21 | doped with tungsten | $5.0 \times 10^2$ | 0.20 | 300 | 0.20 | 23 | 168 |
| 22 | Density: 6.3 g/cm$^3$ | $5.0 \times 10^2$ | 0.20 | 560 | 0.20 | 50 | 168 |
| 23 | | $5.0 \times 10^2$ | 0.20 | 300 | 0.20 | 38 | 168 |
| 24 | | $5.0 \times 10^2$ | 0.20 | 300 | 0.20 | 68 | 168 |
| 25 | | $5.0 \times 10^2$ | 0.20 | 560 | 0.20 | 100 | 168 |
| 26 | | $5.0 \times 10^2$ | 0.20 | 560 | 0.20 | 149 | 168 |
| 27 | | $5.0 \times 10^2$ | 0.45 | 300 | 0.20 | 23 | 168 |
| 28 | | $5.0 \times 10^2$ | 0.45 | 300 | 0.40 | 23 | 168 |
| 29 | | $5.0 \times 10^2$ | 0.15 | 300 | 0.15 | 23 | 168 |
| 30 | | $5.0 \times 10^2$ | 0.15 | 300 | 0.10 | 23 | 168 |
| 31 | Zinc oxide particles | $5.0 \times 10^2$ | 0.20 | 140 | 0.20 | 10 | 168 |
| 32 | coated with tin oxide | $5.0 \times 10^2$ | 0.20 | 290 | 0.20 | 14 | 168 |
| 33 | doped with fluorine | $5.0 \times 10^2$ | 0.20 | 290 | 0.20 | 23 | 168 |
| 34 | Density: 6.0 g/cm$^3$ | $5.0 \times 10^2$ | 0.20 | 540 | 0.20 | 50 | 168 |
| 35 | | $5.0 \times 10^2$ | 0.20 | 290 | 0.20 | 39 | 168 |
| 36 | | $5.0 \times 10^2$ | 0.20 | 290 | 0.20 | 70 | 168 |
| 37 | | $5.0 \times 10^2$ | 0.20 | 540 | 0.20 | 101 | 168 |
| 38 | | $5.0 \times 10^2$ | 0.20 | 540 | 0.20 | 151 | 168 |
| 39 | | $5.0 \times 10^2$ | 0.45 | 290 | 0.20 | 23 | 168 |
| 40 | | $5.0 \times 10^2$ | 0.45 | 290 | 0.40 | 23 | 168 |
| 41 | | $5.0 \times 10^2$ | 0.15 | 290 | 0.15 | 23 | 168 |
| 42 | | $5.0 \times 10^2$ | 0.15 | 290 | 0.10 | 23 | 168 |

TABLE 2

Table 2

| Conductive layer-forming coating solution | First metal oxide particles: Type | Powder resistivity [Ω · cm] | Volume-average particle diameter [μm] | Amount [part] | Second metal oxide particles (uncoated zinc oxide particles): Volume-average particle diameter [μm] | Amount [part] | Binder material (B) (phenolic resin): Amount [part] (resin solid content is 60 mass % of the following value) |
|---|---|---|---|---|---|---|---|
| 43 | Zinc oxide | $5.0 \times 10^2$ | 0.20 | 150 | 0.20 | 10 | 168 |
| 44 | particles coated | $5.0 \times 10^2$ | 0.20 | 300 | 0.20 | 14 | 168 |
| 45 | with tin oxide | $5.0 \times 10^2$ | 0.20 | 300 | 0.20 | 23 | 168 |
| 46 | doped with | $5.0 \times 10^2$ | 0.20 | 550 | 0.20 | 50 | 168 |
| 47 | niobium | $5.0 \times 10^2$ | 0.20 | 300 | 0.20 | 39 | 168 |
| 48 | Density: 6.2 g/cm$^3$ | $5.0 \times 10^2$ | 0.20 | 300 | 0.20 | 70 | 168 |
| 49 | | $5.0 \times 10^2$ | 0.20 | 550 | 0.20 | 100 | 168 |
| 50 | | $5.0 \times 10^2$ | 0.20 | 550 | 0.20 | 149 | 168 |
| 51 | | $5.0 \times 10^2$ | 0.45 | 300 | 0.20 | 23 | 168 |
| 52 | | $5.0 \times 10^2$ | 0.45 | 300 | 0.40 | 23 | 168 |
| 53 | | $5.0 \times 10^2$ | 0.15 | 300 | 0.15 | 23 | 168 |
| 54 | | $5.0 \times 10^2$ | 0.15 | 300 | 0.10 | 23 | 168 |
| 55 | Zinc oxide | $5.0 \times 10^2$ | 0.20 | 150 | 0.20 | 10 | 168 |
| 56 | particles coated | $5.0 \times 10^2$ | 0.20 | 300 | 0.20 | 14 | 168 |
| 57 | with tin oxide | $5.0 \times 10^2$ | 0.20 | 300 | 0.20 | 23 | 168 |
| 58 | doped with | $5.0 \times 10^2$ | 0.20 | 560 | 0.20 | 50 | 168 |
| 59 | tantalum | $5.0 \times 10^2$ | 0.20 | 300 | 0.20 | 38 | 168 |
| 60 | Density: 6.3 g/cm$^3$ | $5.0 \times 10^2$ | 0.20 | 300 | 0.20 | 69 | 168 |
| 61 | | $5.0 \times 10^2$ | 0.20 | 560 | 0.20 | 100 | 168 |
| 62 | | $5.0 \times 10^2$ | 0.20 | 560 | 0.20 | 149 | 168 |
| 63 | | $5.0 \times 10^2$ | 0.45 | 300 | 0.20 | 23 | 168 |
| 64 | | $5.0 \times 10^2$ | 0.45 | 300 | 0.40 | 23 | 168 |
| 65 | | $5.0 \times 10^2$ | 0.15 | 300 | 0.15 | 23 | 168 |
| 66 | | $5.0 \times 10^2$ | 0.15 | 300 | 0.10 | 23 | 168 |

TABLE 3

Table 3

| Conductive layer-forming coating solution | First metal oxide particles: Type | Powder resistivity [Ω · cm] | Volume-average particle diameter [μm] | Amount [part] | Second metal oxide particles (uncoated zinc oxide particles): Volume-average particle diameter [μm] | Amount [part] | Binder material (B) (phenolic resin): Amount [part] (resin solid content is 60 mass % of the following value) |
|---|---|---|---|---|---|---|---|
| C1 | Zinc oxide particles | $5.0 \times 10^2$ | 0.20 | 100 | 0.20 | 9 | 168 |
| C2 | coated with tin oxide | $5.0 \times 10^2$ | 0.20 | 660 | 0.20 | 55 | 168 |
| C3 | doped with | $5.0 \times 10^2$ | 0.20 | 290 | not used | | 168 |
| C4 | phosphorus | $5.0 \times 10^2$ | 0.20 | 290 | 0.20 | 0.4 | 168 |
| C5 | Density: 6.1 g/cm$^3$ | $5.0 \times 10^2$ | 0.20 | 530 | 0.20 | 0.4 | 168 |
| C6 | | $5.0 \times 10^2$ | 0.20 | 290 | 0.20 | 190 | 168 |
| C7 | | $5.0 \times 10^2$ | 0.20 | 540 | 0.20 | 250 | 168 |
| C8 | | $5.0 \times 10^2$ | 0.20 | 290 | 0.20 | 1 | 168 |
| C9 | | $5.0 \times 10^2$ | 0.20 | 290 | 0.20 | 91 | 168 |
| C10 | Zinc oxide particles | $5.0 \times 10^2$ | 0.20 | 100 | 0.20 | 9 | 168 |
| C11 | coated with tin oxide | $5.0 \times 10^2$ | 0.20 | 680 | 0.20 | 55 | 168 |
| C12 | doped with tungsten | $5.0 \times 10^2$ | 0.20 | 300 | not used | | 168 |
| C13 | Density: 6.3 g/cm$^3$ | $5.0 \times 10^2$ | 0.20 | 300 | 0.20 | 0.4 | 168 |
| C14 | | $5.0 \times 10^2$ | 0.20 | 560 | 0.20 | 250 | 168 |
| C15 | | $5.0 \times 10^2$ | 0.20 | 300 | 0.20 | 1 | 168 |
| C16 | | $5.0 \times 10^2$ | 0.20 | 300 | 0.20 | 92 | 168 |
| C17 | Zinc oxide particles | $5.0 \times 10^2$ | 0.20 | 90 | 0.20 | 8 | 168 |
| C18 | coated with tin oxide | $5.0 \times 10^2$ | 0.20 | 650 | 0.20 | 55 | 168 |
| C19 | doped with fluorine | $5.0 \times 10^2$ | 0.20 | 290 | not used | | 168 |
| C20 | Density: 6.0 g/cm$^3$ | $5.0 \times 10^2$ | 0.20 | 290 | 0.20 | 0.4 | 168 |
| C21 | | $5.0 \times 10^2$ | 0.20 | 530 | 0.20 | 248 | 168 |
| C22 | | $5.0 \times 10^2$ | 0.20 | 290 | 0.20 | 1 | 168 |
| C23 | | $5.0 \times 10^2$ | 0.20 | 290 | 0.20 | 93 | 168 |
| C24 | Zinc oxide particles | $5.0 \times 10^2$ | 0.20 | 100 | 0.20 | 9 | 168 |

TABLE 3-continued

Table 3

| Conductive layer-forming coating solution | First metal oxide particles: Type | Powder resistivity [Ω · cm] | Volume-average particle diameter [μm] | Amount [part] | Second metal oxide particles (uncoated zinc oxide particles): Volume-average particle diameter [μm] | Amount [part] | Binder material (B) (phenolic resin): Amount [part] (resin solid content is 60 mass % of the following value) |
|---|---|---|---|---|---|---|---|
| C25 | coated with tin oxide | $5.0 \times 10^2$ | 0.20 | 670 | 0.20 | 55 | 168 |
| C26 | doped with niobium | $5.0 \times 10^2$ | 0.20 | 300 | not used | | 168 |
| C27 | Density: 6.2 g/cm$^3$ | $5.0 \times 10^2$ | 0.20 | 300 | 0.20 | 0.4 | 168 |
| C28 | | $5.0 \times 10^2$ | 0.20 | 550 | 0.20 | 250 | 168 |
| C29 | | $5.0 \times 10^2$ | 0.20 | 300 | 0.20 | 1 | 168 |
| C30 | | $5.0 \times 10^2$ | 0.20 | 300 | 0.20 | 93 | 168 |
| C31 | Zinc oxide particles | $5.0 \times 10^2$ | 0.20 | 100 | 0.20 | 9 | 168 |
| C32 | coated with tin oxide | $5.0 \times 10^2$ | 0.20 | 680 | 0.20 | 55 | 168 |
| C33 | doped with tantalum | $5.0 \times 10^2$ | 0.20 | 300 | not used | | 168 |
| C34 | Density: 6.3 g/cm$^3$ | $5.0 \times 10^2$ | 0.20 | 300 | 0.20 | 0.4 | 168 |
| C35 | | $5.0 \times 10^2$ | 0.20 | 560 | 0.20 | 250 | 168 |
| C36 | | $5.0 \times 10^2$ | 0.20 | 300 | 0.20 | 1 | 168 |
| C37 | | $5.0 \times 10^2$ | 0.20 | 300 | 0.20 | 92 | 168 |

TABLE 4

Table 4

| Conductive layer-forming coating solution | First metal oxide particles: Type | Powder resistivity [Ω · cm] | Volume-average particle diameter [μm] | Amount [part] | Second metal oxide particles (uncoated tin oxide particles): Volume-average particle diameter [μm] | Amount [part] | Binder material (B) (phenolic resin): Amount [part] (resin solid content is 60 mass % of the following value) |
|---|---|---|---|---|---|---|---|
| 67 | Tin oxide particles | $5.0 \times 10^2$ | 0.20 | 160 | 0.20 | 11 | 168 |
| 68 | coated with tin oxide | $5.0 \times 10^2$ | 0.20 | 170 | 0.20 | 35 | 168 |
| 69 | doped with | $5.0 \times 10^2$ | 0.20 | 170 | 0.20 | 52 | 168 |
| 70 | phosphorus | $5.0 \times 10^2$ | 0.20 | 330 | 0.20 | 2 | 168 |
| 71 | Density: 6.8 g/cm$^3$ | $5.0 \times 10^2$ | 0.20 | 330 | 0.20 | 29 | 168 |
| 72 | | $5.0 \times 10^2$ | 0.20 | 610 | 0.20 | 63 | 168 |
| 73 | | $5.0 \times 10^2$ | 0.20 | 610 | 0.20 | 31 | 168 |
| 74 | | $5.0 \times 10^2$ | 0.20 | 330 | 0.20 | 48 | 168 |
| 75 | | $5.0 \times 10^2$ | 0.20 | 330 | 0.20 | 87 | 168 |
| 76 | | $5.0 \times 10^2$ | 0.20 | 610 | 0.20 | 125 | 168 |
| 77 | | $5.0 \times 10^2$ | 0.20 | 610 | 0.20 | 187 | 168 |
| 78 | | $5.0 \times 10^2$ | 0.45 | 330 | 0.20 | 17 | 168 |
| 79 | | $5.0 \times 10^2$ | 0.45 | 330 | 0.40 | 17 | 168 |
| 80 | | $5.0 \times 10^2$ | 0.15 | 330 | 0.15 | 17 | 168 |
| 81 | | $5.0 \times 10^2$ | 0.15 | 330 | 0.10 | 17 | 168 |
| 82 | | $2.0 \times 10^2$ | 0.20 | 330 | 0.20 | 29 | 168 |
| 83 | | $1.5 \times 10^3$ | 0.20 | 330 | 0.20 | 29 | 168 |
| 84 | | $5.0 \times 10^2$ | 0.20 | 170 | 0.20 | 12 | 168 |
| 85 | Tin oxide particles | $5.0 \times 10^2$ | 0.20 | 170 | 0.20 | 12 | 168 |
| 86 | coated with tin oxide | $5.0 \times 10^2$ | 0.20 | 350 | 0.20 | 17 | 168 |
| 87 | doped with tungsten | $5.0 \times 10^2$ | 0.20 | 350 | 0.20 | 29 | 168 |
| 88 | Density: 7.2 g/cm$^3$ | $5.0 \times 10^2$ | 0.20 | 640 | 0.20 | 62 | 168 |
| 89 | Tin oxide particles | $5.0 \times 10^2$ | 0.20 | 160 | 0.20 | 12 | 168 |
| 90 | coated with tin oxide | $5.0 \times 10^2$ | 0.20 | 330 | 0.20 | 17 | 168 |
| 91 | doped with fluorine | $5.0 \times 10^2$ | 0.20 | 330 | 0.20 | 29 | 168 |
| 92 | Density: 6.8 g/cm$^3$ | $5.0 \times 10^2$ | 0.20 | 610 | 0.20 | 62 | 168 |
| 93 | Tin oxide particles | $5.0 \times 10^2$ | 0.20 | 160 | 0.20 | 12 | 168 |
| 94 | coated with tin oxide | $5.0 \times 10^2$ | 0.20 | 340 | 0.20 | 17 | 168 |
| 95 | doped with niobium | $5.0 \times 10^2$ | 0.20 | 340 | 0.20 | 29 | 168 |
| 96 | Density: 7.0 g/cm$^3$ | $5.0 \times 10^2$ | 0.20 | 630 | 0.20 | 63 | 168 |
| 97 | Tin oxide particles | $5.0 \times 10^2$ | 0.20 | 170 | 0.20 | 13 | 168 |
| 98 | coated with tin oxide | $5.0 \times 10^2$ | 0.20 | 350 | 0.20 | 187 | 168 |
| 99 | doped with tantalum | $5.0 \times 10^2$ | 0.20 | 350 | 0.20 | 29 | 168 |
| 100 | Density: 7.1 g/cm$^3$ | $5.0 \times 10^2$ | 0.20 | 640 | 0.20 | 63 | 168 |

TABLE 5

Table 5

| Conductive layer-forming coating solution | First metal oxide particles: Type | Powder resistivity [Ω · cm] | Volume-average particle diameter [μm] | Amount [part] | Second metal oxide particles (uncoated tin oxide particles): Volume-average particle diameter [μm] | Amount [part] | Binder material (B) (phenolic resin): Amount [part] (resin solid content is 60 mass % of the following value) |
|---|---|---|---|---|---|---|---|
| C43 | Tin oxide particles | $5.0 \times 10^2$ | 0.20 | 110 | 0.20 | 11 | 168 |
| C44 | coated with tin oxide | $5.0 \times 10^2$ | 0.20 | 800 | 0.20 | 74 | 168 |
| C45 | doped with | $5.0 \times 10^2$ | 0.20 | 330 | not used | | 168 |
| C46 | phosphorus | $5.0 \times 10^2$ | 0.20 | 330 | 0.20 | 0.5 | 168 |
| C47 | Density: 6.8 g/cm$^3$ | $5.0 \times 10^2$ | 0.20 | 610 | 0.20 | 312 | 168 |
| C48 | | $5.0 \times 10^2$ | 0.20 | 330 | 0.20 | 11 | 168 |
| C49 | | $5.0 \times 10^2$ | 0.20 | 330 | 0.20 | 120 | 168 |
| C50 | Tin oxide particles | $5.0 \times 10^2$ | 0.20 | 110 | 0.20 | 11 | 168 |
| C51 | coated with tin oxide | $5.0 \times 10^2$ | 0.20 | 820 | 0.20 | 72 | 168 |
| C52 | doped with tungsten | $5.0 \times 10^2$ | 0.20 | 350 | not used | | 168 |
| C53 | Density: 7.2 g/cm$^3$ | $5.0 \times 10^2$ | 0.20 | 350 | 0.20 | 0.5 | 168 |
| C54 | | $5.0 \times 10^2$ | 0.20 | 650 | 0.20 | 313 | 168 |
| C55 | | $5.0 \times 10^2$ | 0.20 | 350 | 0.20 | 1 | 168 |
| C56 | | $5.0 \times 10^2$ | 0.20 | 350 | 0.20 | 116 | 168 |
| C57 | Tin oxide particles | $5.0 \times 10^2$ | 0.20 | 110 | 0.20 | 11 | 168 |
| C58 | coated with tin oxide | $5.0 \times 10^2$ | 0.20 | 780 | 0.20 | 73 | 168 |
| C59 | doped with fluorine | $5.0 \times 10^2$ | 0.20 | 330 | not used | | 168 |
| C60 | Density: 6.8 g/cm$^3$ | $5.0 \times 10^2$ | 0.20 | 330 | 0.20 | 0.5 | 168 |
| C61 | | $5.0 \times 10^2$ | 0.20 | 610 | 0.20 | 312 | 168 |
| C62 | | $5.0 \times 10^2$ | 0.20 | 330 | 0.20 | 1 | 168 |
| C63 | | $5.0 \times 10^2$ | 0.20 | 330 | 0.20 | 116 | 168 |
| C64 | Tin oxide particles | $5.0 \times 10^2$ | 0.20 | 110 | 0.20 | 11 | 168 |
| C65 | coated with tin oxide | $5.0 \times 10^2$ | 0.20 | 790 | 0.20 | 71 | 168 |
| C66 | doped with niobium | $5.0 \times 10^2$ | 0.20 | 340 | not used | | 168 |
| C67 | Density: 7.0 g/cm$^3$ | $5.0 \times 10^2$ | 0.20 | 340 | 0.20 | 0.5 | 168 |
| C68 | | $5.0 \times 10^2$ | 0.20 | 630 | 0.20 | 313 | 168 |
| C69 | | $5.0 \times 10^2$ | 0.20 | 340 | 0.20 | 1 | 168 |
| C70 | | $5.0 \times 10^2$ | 0.20 | 340 | 0.20 | 116 | 168 |
| C71 | Tin oxide particles | $5.0 \times 10^2$ | 0.20 | 110 | 0.20 | 11 | 168 |
| C72 | coated with tin oxide | $5.0 \times 10^2$ | 0.20 | 820 | 0.20 | 73 | 168 |
| C73 | doped with tantalum | $5.0 \times 10^2$ | 0.20 | 350 | not used | | 168 |
| C74 | Density: 7.1 g/cm$^3$ | $5.0 \times 10^2$ | 0.20 | 350 | 0.20 | 0.5 | 168 |
| C75 | | $5.0 \times 10^2$ | 0.20 | 640 | 0.20 | 314 | 168 |
| C76 | | $5.0 \times 10^2$ | 0.20 | 350 | 0.20 | 1 | 168 |
| C77 | | $5.0 \times 10^2$ | 0.20 | 350 | 0.20 | 118 | 168 |

Preparation Example of Conductive Layer-Forming Coating Solution C38

The second metal oxide particles used in the preparation of the conductive layer-forming coating solution were changed to 38 parts of uncoated tin oxide particles (powder resistivity: $5.0\times10^7$ Ω·cm, volume-average particle diameter: 0.20 μm, density: 6.95 g/cm$^3$). Except for the above change, a conductive layer-forming coating solution C38 was prepared in the same manner as in Preparation Example of the conductive layer-forming coating solution 8.

Preparation Example of Conductive Layer-Forming Coating Solution C39

The second metal oxide particles used in the preparation of the conductive layer-forming coating solution were changed to 38 parts of uncoated titanium oxide particles (rutile titanium oxide, powder resistivity: $5.0\times10^7$ Ω·cm, volume-average particle diameter: 0.20 μm, density: 4.2 g/cm$^3$). Except for the above change, a conductive layer-forming coating solution C39 was prepared in the same manner as in Preparation Example of the conductive layer-forming coating solution 1.

Preparation Example of Conductive Layer-Forming Coating Solution C40

The first metal oxide particles and the second metal oxide particles used in the preparation of the conductive layer-forming coating solution were changed to 200 parts of tin oxide particles doped with phosphorus (powder resistivity: $5.0\times10^1$ Ω·cm, volume-average particle diameter: 0.02 μm, density: 6.7 g/cm$^3$). Except for the above change, a conductive layer-forming coating solution C40 was prepared in the same manner as in Preparation Example of the conductive layer-forming coating solution 1.

Preparation Example of Conductive Layer-Forming Coating Solution C41

The first metal oxide particles and the second metal oxide particles used in the preparation of the conductive layer-forming coating solution were changed to 300 parts of uncoated tin-zinc composite oxide particles (powder resistivity: $7.0\times10^7$ Ω·cm, volume-average particle diameter: 0.20 μm, density: 6.3 g/cm$^3$). Except for the above change, a conductive layer-forming coating solution C41 was prepared in the same manner as in Preparation Example of the conductive layer-forming coating solution 1.

Preparation Example of Conductive Layer-Forming Coating Solution C42

The first metal oxide particles and the second metal oxide particles used in the preparation of the conductive layer-forming coating solution were changed to 150 parts of uncoated zinc oxide particles (powder resistivity: $5.0\times10^7$ Ω·cm, volume-average particle diameter: 0.20 μm, density: 5.61 g/cm$^3$) and 150 parts of uncoated tin oxide particles (powder resistivity: $5.0\times10^7$ Ω·cm, volume-average particle diameter: 0.20 μm, density: 6.95 g/cm$^3$). Except for the above change, a conductive layer-forming coating solution C42 was prepared in the same manner as in Preparation Example of the conductive layer-forming coating solution 1.

Preparation Example of Conductive Layer-Forming Coating Solution C78

A conductive layer-forming coating solution was prepared in the same manner as in the conductive layer-forming coating solution L-4 described in Japanese Unexamined Patent Application Publication No. 2012-18370. This solution was treated as a conductive layer-forming coating solution C78.

Specifically, 54.8 parts of titanium oxide particles coated with tin oxide doped with phosphorus (volume-average particle diameter: 0.15 μm, powder resistivity: $2.0\times10^2$ Ω·cm, coating ratio of tin oxide ($SnO_2$): 15 mass %, amount (doping amount) of phosphorus with which tin oxide is doped: 7 mass %), 36.5 parts of phenolic resin (trade name: Plyophen J-325), and 50 parts of methoxypropanol (1-methoxy-2-propanol) serving as a solvent were inserted into a sand mill together with glass beads having a diameter of 0.5 mm. A dispersion treatment was performed at a disc rotational speed of 2500 rpm for a dispersion treatment time of 3.5 hours to obtain a dispersion liquid. To this dispersion liquid, 3.9 parts of silicone resin particles (trade name: Tospearl 120) and 0.001 parts of silicone oil (trade name: SH28PA) were added, and stirring was performed to prepare a conductive layer-forming coating solution C78.

Preparation Example of Conductive Layer-Forming Coating Solution C79

A conductive layer-forming coating solution was prepared in the same manner as in the conductive layer-forming coating solution L-14 described in Japanese Unexamined Patent Application Publication No. 2012-18370. This solution was treated as a conductive layer-forming coating solution C79.

Specifically, 37.5 parts of titanium oxide particles coated with tin oxide doped with tungsten (volume-average particle diameter: 0.15 μm, powder resistivity: $2.5\times10^2$ Ω·cm, coating ratio of tin oxide: 15 mass %, amount (doping amount) of tungsten with which tin oxide is doped: 7 mass %), 36.5 parts of phenolic resin (trade name: Plyophen J-325), and 50 parts of methoxypropanol serving as a solvent were inserted into a sand mill together with glass beads having a diameter of 0.5 mm. A dispersion treatment was performed at a disc rotational speed of 2500 rpm for a dispersion treatment time of 3.5 hours to obtain a dispersion liquid. To this dispersion liquid, 3.9 parts of silicone resin particles (trade name: Tospearl 120) and 0.001 parts of silicone oil (trade name: SH28PA) were added, and stirring was performed to prepare a conductive layer-forming coating solution C79.

Preparation Example of Conductive Layer-Forming Coating Solution C80

A conductive layer-forming coating solution was prepared in the same manner as in the conductive layer-forming coating solution L-30 described in Japanese Unexamined Patent Application Publication No. 2012-18370. This solution was treated as a conductive layer-forming coating solution C80.

Specifically, 60 parts of titanium oxide particles coated with tin oxide doped with fluorine (volume-average particle diameter: 0.075 μm, powder resistivity: $3.0\times10^2$ Ω·cm, coating ratio of tin oxide: 15 mass %, amount (doping amount) of fluorine with which tin oxide is doped: 7 mass %), 36.5 parts of phenolic resin (trade name: Plyophen J-325), and 50 parts of methoxypropanol were inserted into a sand mill together with glass beads having a diameter of 0.5 mm. A dispersion treatment was performed at a disc rotational speed of 2500 rpm for a dispersion treatment time of 3.5 hours to obtain a dispersion liquid. To this dispersion liquid, 3.9 parts of silicone resin particles (trade name: Tospearl 120) and 0.001 parts of silicone oil (trade name: SH28PA) were added, and stirring was performed to prepare a conductive layer-forming coating solution C80.

Preparation Example of Conductive Layer-Forming Coating Solution C81

A conductive layer-forming coating solution was prepared in the same manner as in the conductive layer-forming coating solution 1 described in Japanese Unexamined Patent Application Publication No. 2012-18371. This solution was treated as a conductive layer-forming coating solution C81.

Specifically, 204 parts of titanium oxide particles coated with tin oxide doped with phosphorus (powder resistivity: $4.0\times10^1$ Ω·cm, coating ratio of tin oxide: 35 mass %, amount (doping amount) of phosphorus (P) with which tin oxide is doped: 3 mass %), 148 parts of phenolic resin (trade name: Plyophen J-325), and 98 parts of 1-methoxy-2-propanol were inserted into a sand mill together with 450 parts of glass beads having a diameter of 0.8 mm. A dispersion treatment was performed under dispersion treatment conditions of rotational speed: 2000 rpm, dispersion treatment time: 4 hours, and temperature of cooling water: 18° C. to obtain a dispersion liquid. After the glass beads were removed from the dispersion liquid with a mesh, 13.8 parts of silicone resin particles (trade name: Tospearl 120) and 0.014 parts of silicone oil (trade name: SH28PA) were added to the dispersion liquid. Furthermore, 6 parts of methanol and 6 parts of 1-methoxy-2-propanol were added thereto, and stirring was performed to prepare a conductive layer-forming coating solution C81.

Preparation Example of Conductive Layer-Forming Coating Solution C82

A conductive layer-forming coating solution was prepared in the same manner as in the conductive layer-forming coating solution 10 described in Japanese Unexamined Patent Application Publication No. 2012-18371. This solution was treated as a conductive layer-forming coating solution C82.

Specifically, 204 parts of titanium oxide particles coated with tin oxide doped with tungsten (powder resistivity:

$2.5\times10^{1}$ Ω·cm, coating ratio of tin oxide: 33 mass %, amount (doping amount) of tungsten with which tin oxide is doped: 3 mass %), 148 parts of phenolic resin (trade name: Plyophen J-325), and 98 parts of 1-methoxy-2-propanol were inserted into a sand mill together with 450 parts of glass beads having a diameter of 0.8 mm. A dispersion treatment was performed under dispersion treatment conditions of rotational speed: 2000 rpm, dispersion treatment time: 4 hours, and temperature of cooling water: 18° C. to obtain a dispersion liquid. After the glass beads were removed from the dispersion liquid with a mesh, 13.8 parts of silicone resin particles (trade name: Tospearl 120) and 0.014 parts of silicone oil (trade name: SH28PA) were added to the dispersion liquid. Furthermore, 6 parts of methanol and 6 parts of 1-methoxy-2-propanol were added thereto, and stirring was performed to prepare a conductive layer-forming coating solution C82.

Production Examples of Electrophotographic Photosensitive Members

Example 1

Production Example of Electrophotographic Photosensitive Member 1

An aluminum cylinder (JIS A 3003, aluminum alloy) with a length of 257 mm, a diameter of 24 mm, and a thickness of 1.0 mm, which was produced by a method including extrusion and drawing, was used as a support (conductive support).

The conductive layer-forming coating solution 1 was applied onto the support by dipping in an ordinary-temperature and ordinary-humidity environment (23° C./50% RH) to form a coating film. The resulting coating film was dried and heat-cured at 140° C. for 30 minutes to form a conductive layer having a thickness of 28 μm.

The volume resistivity of the conductive layer was measured by the above-described method. The volume resistivity was $1.8\times10^{12}$ Ω·cm.

Subsequently, an undercoat layer-forming coating solution was prepared by dissolving 4.5 parts of N-methoxymethylated nylon (trade name: Toresin EF-30T manufactured by Nagase ChemteX Corporation) and 1.5 parts of copolymer nylon resin (trade name: Amilan CM8000 manufactured by Toray Industries, Inc.) in a mixed solvent of methanol 65 parts/n-butanol 30 parts. The undercoat layer-forming coating solution was applied onto the conductive layer by dipping. The resulting coating film was dried at 70° C. for 6 minutes to form an undercoat layer having a thickness of 0.85 μm.

Subsequently, a hydroxygallium phthalocyanine crystal (charge generation material) having peaks at Bragg angles (2θ±0.2°) of 7.5°, 9.9°, 16.3°, 18.6°, 25.1°, and 28.3° in CuKα characteristic X-ray diffraction was prepared. Into a sand mill, 10 parts of the hydroxygallium phthalocyanine crystal, 5 parts of polyvinyl butyral (trade name: S-LEC BX-1 manufactured by SEKISUI CHEMICAL CO., LTD.), and 250 parts of cyclohexanone were inserted together with glass beads having a diameter of 0.8 mm. A dispersion treatment was performed for a dispersion treatment time of 3 hours. Then, 250 parts of ethyl acetate was added to prepare a charge generating layer-forming coating solution. The charge generating layer-forming coating solution was applied onto the undercoat layer by dipping. The resulting coating film was dried at 100° C. for 10 minutes to form a charge generating layer having a thickness of 0.15 μm.

Subsequently, 6.0 parts of an amine compound (charge transport material) represented by formula (CT-1) below, (CT-1)

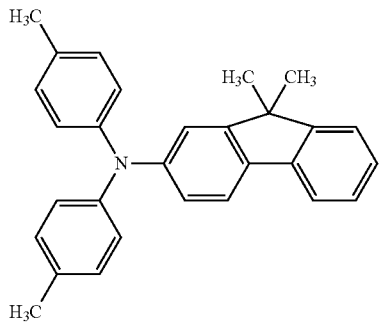

2.0 parts of an amine compound (charge transport material) represented by formula (CT-2) below, (CT-2)

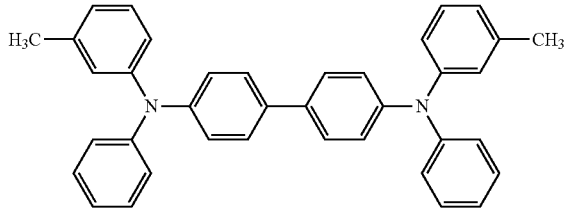

10 parts of bisphenol Z polycarbonate (trade name: 2400 manufactured by Mitsubishi Engineering-Plastics Corporation), and 0.36 parts of siloxane-modified polycarbonate having a structural unit represented by formula (B-1) below, a structural unit represented by formula (B-2) below, and a terminal structure represented by formula (B-3) below ((B-1):(B-2):(B-3)=70:20:10 (molar ratio))

(B-1)

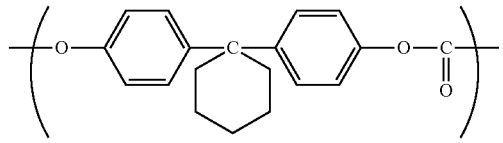

(B-2)

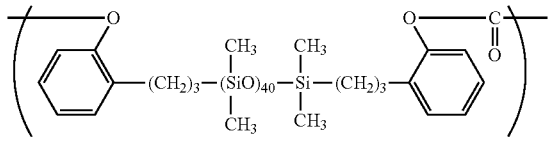

(B-3)

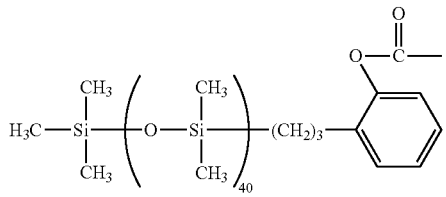

were dissolved in a mixed solvent containing 60 parts of o-xylene, 40 parts of dimethoxymethane, and 2.7 parts of methyl benzoate to prepare a charge transporting layer-forming coating solution. The charge transporting layer-forming coating solution was applied onto the charge generating layer by dipping. The resulting coating film was dried at 125° C. for 30 minutes to form a charge transporting layer having a thickness of 10.0 μm. Thus, an electrophotographic photosensitive member 1 whose charge transporting layer served as a surface layer was produced. Examples 2 to 100 and Comparative Examples 1 to 82 (Production Examples of electrophotographic photosensitive members 2 to 100 and C1 to C82)

The conductive layer-forming coating solution 1 used in the production of the electrophotographic photosensitive member was changed to each of conductive layer-forming coating solutions 2 to 100 and C1 to C82. Except for the above change, electrophotographic photosensitive members 2 to 100 and C1 to C82 whose charge transporting layer served as a surface layer were produced in the same manner as in Production Example of the electrophotographic photosensitive member 1. The volume resistivity of the conductive layer was measured in the same manner as in the electrophotographic photosensitive member 1. Tables 6 to 9 show the results.

The electrophotographic photosensitive members 1 to 100 and C1 to C82 were each produced for the conductive layer analysis and for the repeated printing test.

Production Examples of Electrophotographic Photosensitive Members 101 to 200 and C101 to C182

The thickness of the charge transporting layer was changed to 5.0 μm to provide an electrophotographic photosensitive member for a needle withstand voltage test. Except for the above change, electrophotographic photosensitive members 101 to 200 and C101 to C182 whose charge transporting layer served as a surface layer were produced in the same manner as in Production Examples of the electrophotographic photosensitive members 1 to 100 and C1 to C82.

Examples 1 to 100 and Comparative Examples 1 to 82

Analysis of Conductive Layer of Electrophotographic Photosensitive Member

Each of the electrophotographic photosensitive members 1 to 100 and C1 to C82 for the conductive layer analysis was cut into five slices with sides of 5 mm. The undercoat layer, the charge transporting layer, and the charge generating layer of each of the five slices were then removed by being dissolved with chlorobenzene, methyl ethyl ketone, and methanol to expose the conductive layer. Thus, five observation specimens were prepared from each of the electrophotographic photosensitive members.

First, the conductive layer of one of the observation specimens was sliced so as to have a thickness of 150 nm by an FIB-μ sampling method using a focused ion beam system (trade name: FB-2000A manufactured by Hitachi High-Tech Manufacturing & Service Corporation). The composition analysis of the conductive layer was then performed with a field emission electron microscope (HRTEM) (trade name: JEM-2100F manufactured by JEOL Ltd.) and an energy dispersive X-ray spectrometer (EDX) (trade name: JED-2300T manufactured by JEOL Ltd). The measurement conditions of EDX were acceleration voltage: 200 kV and beam size: 1.0 nm.

As a result, it was confirmed that the conductive layer of each of the electrophotographic photosensitive members 1 to 18, C1 to C9, C38, and C39 contained zinc oxide particles coated with tin oxide doped with phosphorus. It was also confirmed that the conductive layer of each of the electrophotographic photosensitive members 19 to 30 and C10 to C16 contained zinc oxide particles coated with tin oxide doped with tungsten. It was also confirmed that the conductive layer of each of the electrophotographic photosensitive members 31 to 42 and C17 to C23 contained zinc oxide particles coated with tin oxide doped with fluorine. It was also confirmed that the conductive layer of each of the electrophotographic photosensitive members 43 to 54 and C24 to C30 contained zinc oxide particles coated with tin oxide doped with niobium. It was also confirmed that the conductive layer of each of the electrophotographic photosensitive members 55 to 66 and C31 to C37 contained zinc oxide particles coated with tin oxide doped with tantalum.

It was also confirmed that the conductive layer of each of the electrophotographic photosensitive members 1 to 66, C1, C2, C4 to C11, C13 to C18, C20 to C25, C27 to C32, and C34 to C37 contained uncoated zinc oxide particles.

It was also confirmed that the conductive layer of each of the electrophotographic photosensitive members 67 to 84 and C43 to C49 contained tin oxide particles coated with tin oxide doped with phosphorus. It was also confirmed that the conductive layer of each of the electrophotographic photosensitive members 85 to 88 and C50 to C56 contained tin oxide particles coated with tin oxide doped with tungsten. It was also confirmed that the conductive layer of each of the electrophotographic photosensitive members 89 to 92 and C57 to C63 contained tin oxide particles coated with tin oxide doped with fluorine. It was also confirmed that the conductive layer of each of the electrophotographic photosensitive members 93 to 96 and C64 to C70 contained tin oxide particles coated with tin oxide doped with niobium. It was also confirmed that the conductive layer of each of the electrophotographic photosensitive members 97 to 100 and C71 to C77 contained tin oxide particles coated with tin oxide doped with tantalum.

It was also confirmed that the conductive layer of each of the electrophotographic photosensitive members 67 to 100, C38, C43, C44, C46 to C51, C53 to C58, C60 to C65, C67 to C72, and C74 to C77 contained uncoated tin oxide particles.

It was also confirmed that the conductive layer of the electrophotographic photosensitive member C39 contained uncoated titanium oxide particles. It was also confirmed that the conductive layer of the electrophotographic photosensitive member C40 contained tin oxide particles doped with phosphorus. It was also confirmed that the conductive layer of the electrophotographic photosensitive member C41 contained composite particles of zinc oxide and tin oxide. It was also confirmed that the conductive layer of the electrophotographic photosensitive member C42 contained uncoated tin-zinc composite oxide particles. It was also confirmed that the conductive layer of each of the electrophotographic photosensitive members C78 and C81 contained titanium oxide particles coated with tin oxide doped with phosphorus. It was also confirmed that the conductive layer of each of the electrophotographic photosensitive members C79 and C82 contained titanium oxide particles coated with tin oxide doped with tungsten. It was also confirmed that the conductive layer of the electrophotographic photosensitive member C80 contained titanium oxide particles coated with tin oxide doped with fluorine.

Subsequently, in each of the electrophotographic photosensitive members, a portion (length: 2 μm, width: 2 μm, thickness: 2 μm) of the conductive layer of each of the remaining four observation specimens was observed by Slice & View of FIB-SEM to obtain a three-dimensional image. The P-doped tin oxide-coated tin oxide or zinc oxide and the uncoated tin oxide were identified from the difference in the contrast of the Slice & View of FIB-SEM. Thus, the volume of P-doped tin oxide-coated tin oxide or zinc oxide particles, the volume of uncoated zinc oxide or tin oxide particles, and the ratio of uncoated zinc oxide or tin oxide particles in the conductive layer can be determined. The volume and the ratio in the conductive layer in the case where the doping species with which tin oxide is doped is an element other than phosphorus, such as tungsten, fluorine, niobium, or tantalum can also be determined in the same manner. The conditions of Slice & View were as follows in the present invention.

Processing of specimen for analysis: FIB method
Processing and observation apparatus: NVision40 manufactured by SII/Zeiss
Slice interval: 10 nm
Observation conditions:
Acceleration voltage: 1.0 kV
Tilt of specimen: 54°
WD: 5 mm
Detector: BSE detector
Aperture: 60 μm, high current
ABC: ON
Image resolution: 1.25 nm/pixel The analysis region was 2 μm in length×2 μm in width. Information of each section was accumulated, and the volumes $V_1$ and $V_2$ per 2 μm in length×2 μm in width×2 μm in thickness ($V_T$=8 $\mu m^3$) were determined. The measurement was performed at a temperature of 23° C. and a pressure of $1\times10^{-4}$ Pa.

Note that Strata 400S (tilt of specimen: 52°) manufactured by FEI Company may also be used as the processing and observation apparatus.

The information of each section was obtained from the image analysis of areas of the identified P-doped tin oxide-coated zinc oxide or tin oxide and uncoated zinc oxide or tin oxide. The image analysis was performed using the following image processing software.

Image processing software: Image-Pro Plus manufactured by Media Cybernetics

The volume ($V_1$ ($\mu m^3$)) of the first metal oxide particles and the volume ($V_2$ ($\mu m^3$)) of the second metal oxide particles in the volume (unit volume: 8 $\mu m^3$) of 2 μm×2 μm×2 μm were determined for each of the four observation specimens on the basis of the obtained information. Then, ($V_1$ ($\mu m^3$)/8 ($\mu m^3$))×100, ($V_2$ (1 $m^3$)/8 ($\mu m^3$))×100, and ($V_2$ ($\mu m^3$)/$V_1$ ($\mu m^3$))×100 were calculated. The average of values of ($V_1$ ($\mu m^3$)/8 ($\mu m^3$))×100 for the four observation specimens was defined as a content (vol %) of the first metal oxide particles in the conductive layer based on the total volume of the conductive layer. The average of values of ($V_2$ ($\mu m^3$)/8 ($\mu m^3$))×100 for the four observation specimens was defined as a content (vol %) of the second metal oxide particles in the conductive layer based on the total volume of the conductive layer. The average of values of ($V_2$($\mu m^3$)/$V_1$ ($\mu m^3$))×100 for the four observation specimens was defined as a content (vol %) of the second metal oxide particles in the conductive layer based on the first metal oxide particles in the conductive layer.

The volume-average particle diameter of the first metal oxide particles and the volume-average particle diameter of the second metal oxide particles were determined for each of the four observation specimens by the above-described method. The average of the volume-average particle diameters of the first metal oxide particles in the four observation specimens was defined as a volume-average particle diameter ($D_1$) of the first metal oxide particles in the conductive layer. The average of the volume-average particle diameters of the second metal oxide particles in the four observation specimens was defined as a volume-average particle diameter ($D_2$) of the second metal oxide particles in the conductive layer. Tables 6 to 9 show the results.

TABLE 6

Table 6

| Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 1 | 1 | 1 | 21 | 1.6 | 8 | 0.20 | 0.20 | 1.0 | $1.8\times10^{12}$ |
| 2 | 2 | 2 | 20 | 4.3 | 21 | 0.20 | 0.20 | 1.0 | $2.0\times10^{12}$ |
| 3 | 3 | 3 | 20 | 5.7 | 29 | 0.20 | 0.20 | 1.0 | $2.5\times10^{12}$ |
| 4 | 4 | 4 | 34 | 0.26 | 0.8 | 0.20 | 0.20 | 1.0 | $6.0\times10^{10}$ |
| 5 | 5 | 5 | 34 | 3.0 | 9 | 0.20 | 0.20 | 1.0 | $6.3\times10^{10}$ |
| 6 | 6 | 6 | 48 | 4.8 | 10 | 0.20 | 0.20 | 1.0 | $4.6\times10^{8}$ |
| 7 | 7 | 7 | 49 | 2.5 | 5 | 0.20 | 0.20 | 1.0 | $4.5\times10^{8}$ |
| 8 | 8 | 8 | 33 | 4.8 | 15 | 0.20 | 0.20 | 1.0 | $6.5\times10^{10}$ |
| 9 | 9 | 9 | 32 | 8.4 | 26 | 0.20 | 0.20 | 1.0 | $7.0\times10^{10}$ |
| 10 | 10 | 10 | 46 | 9.2 | 20 | 0.20 | 0.20 | 1.0 | $2.0\times10^{9}$ |
| 11 | 11 | 11 | 44 | 13.1 | 30 | 0.20 | 0.20 | 1.0 | $3.0\times10^{9}$ |
| 12 | 12 | 12 | 34 | 1.8 | 5 | 0.45 | 0.20 | 2.3 | $6.0\times10^{10}$ |
| 13 | 13 | 13 | 34 | 1.8 | 5 | 0.45 | 0.40 | 1.1 | $6.0\times10^{10}$ |
| 14 | 14 | 14 | 34 | 1.8 | 5 | 0.15 | 0.15 | 1.0 | $6.0\times10^{10}$ |
| 15 | 15 | 15 | 34 | 1.8 | 5 | 0.15 | 0.10 | 1.5 | $6.0\times10^{10}$ |
| 16 | 16 | 16 | 34 | 3.0 | 9 | 0.20 | 0.20 | 1.0 | $3.3\times10^{9}$ |
| 17 | 17 | 17 | 34 | 3.0 | 9 | 0.20 | 0.20 | 1.0 | $4.0\times10^{11}$ |
| 18 | 18 | 18 | 20 | 3.5 | 18 | 0.20 | 0.18 | 1.1 | $1.2\times10^{12}$ |
| 19 | 19 | 19 | 20 | 1.6 | 8 | 0.20 | 0.20 | 1.0 | $2.2\times10^{12}$ |
| 20 | 20 | 20 | 34 | 1.8 | 5 | 0.20 | 0.20 | 1.0 | $7.0\times10^{10}$ |

TABLE 6-continued

Table 6

| Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 21 | 21 | 21 | 34 | 3.0 | 9 | 0.20 | 0.20 | 1.0 | $7.2 \times 10^{10}$ |
| 22 | 22 | 22 | 47 | 4.8 | 10 | 0.20 | 0.20 | 1.0 | $6.0 \times 10^{8}$ |
| 23 | 23 | 23 | 33 | 4.8 | 15 | 0.20 | 0.20 | 1.0 | $1.0 \times 10^{11}$ |
| 24 | 24 | 24 | 32 | 8.2 | 26 | 0.20 | 0.20 | 1.0 | $2.0 \times 10^{11}$ |
| 25 | 25 | 25 | 45 | 9.2 | 20 | 0.20 | 0.20 | 1.0 | $8.0 \times 10^{10}$ |
| 26 | 26 | 26 | 44 | 13.1 | 30 | 0.20 | 0.20 | 1.0 | $9.5 \times 10^{10}$ |
| 27 | 27 | 27 | 34 | 3.0 | 9 | 0.45 | 0.20 | 2.3 | $7.0 \times 10^{10}$ |
| 28 | 28 | 28 | 34 | 3.0 | 9 | 0.45 | 0.40 | 1.1 | $7.0 \times 10^{10}$ |
| 29 | 29 | 29 | 34 | 3.0 | 9 | 0.15 | 0.15 | 1.0 | $7.0 \times 10^{10}$ |
| 30 | 30 | 30 | 34 | 3.0 | 9 | 0.15 | 0.10 | 1.5 | $7.0 \times 10^{10}$ |
| 31 | 31 | 31 | 20 | 1.6 | 8 | 0.20 | 0.20 | 1.0 | $2.0 \times 10^{12}$ |
| 32 | 32 | 32 | 34 | 1.8 | 5 | 0.20 | 0.20 | 1.0 | $6.5 \times 10^{10}$ |
| 33 | 33 | 33 | 34 | 3.0 | 9 | 0.20 | 0.20 | 1.0 | $6.7 \times 10^{10}$ |
| 34 | 34 | 34 | 48 | 4.8 | 10 | 0.20 | 0.20 | 1.0 | $5.5 \times 10^{8}$ |
| 35 | 35 | 35 | 33 | 4.9 | 15 | 0.20 | 0.20 | 1.0 | $9.3 \times 10^{10}$ |
| 36 | 36 | 36 | 32 | 8.4 | 26 | 0.20 | 0.20 | 1.0 | $1.5 \times 10^{11}$ |
| 37 | 37 | 37 | 45 | 9.2 | 20 | 0.20 | 0.20 | 1.0 | $7.0 \times 10^{10}$ |
| 38 | 38 | 38 | 44 | 13.1 | 30 | 0.20 | 0.20 | 1.0 | $9.0 \times 10^{10}$ |
| 39 | 39 | 39 | 34 | 3.0 | 9 | 0.45 | 0.20 | 2.3 | $6.5 \times 10^{10}$ |
| 40 | 40 | 40 | 34 | 3.0 | 9 | 0.45 | 0.40 | 1.1 | $6.5 \times 10^{10}$ |
| 41 | 41 | 41 | 34 | 3.0 | 9 | 0.15 | 0.15 | 1.0 | $6.5 \times 10^{10}$ |
| 42 | 42 | 42 | 34 | 3.0 | 9 | 0.15 | 0.10 | 1.5 | $6.5 \times 10^{10}$ |
| 43 | 43 | 43 | 21 | 1.6 | 8 | 0.20 | 0.20 | 1.0 | $2.5 \times 10^{12}$ |
| 44 | 44 | 44 | 34 | 1.8 | 5 | 0.20 | 0.20 | 1.0 | $8.2 \times 10^{10}$ |
| 45 | 45 | 45 | 34 | 3.0 | 9 | 0.20 | 0.20 | 1.0 | $7.7 \times 10^{10}$ |
| 46 | 46 | 46 | 47 | 4.8 | 10 | 0.20 | 0.20 | 1.0 | $6.0 \times 10^{8}$ |
| 47 | 47 | 47 | 33 | 4.9 | 15 | 0.20 | 0.20 | 1.0 | $9.8 \times 10^{10}$ |
| 48 | 48 | 48 | 32 | 8.4 | 26 | 0.20 | 0.20 | 1.0 | $1.8 \times 10^{11}$ |
| 49 | 49 | 49 | 45 | 9.2 | 20 | 0.20 | 0.20 | 1.0 | $8.0 \times 10^{10}$ |

TABLE 7

Table 7

| Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 50 | 50 | 50 | 44 | 13.1 | 30 | 0.20 | 0.20 | 1.0 | $9.6 \times 10^{10}$ |
| 51 | 51 | 51 | 34 | 3.0 | 9 | 0.45 | 0.20 | 2.3 | $7.0 \times 10^{10}$ |
| 52 | 52 | 52 | 34 | 3.0 | 9 | 0.45 | 0.40 | 1.1 | $7.0 \times 10^{10}$ |
| 53 | 53 | 53 | 34 | 3.0 | 9 | 0.15 | 0.15 | 1.0 | $7.0 \times 10^{10}$ |
| 54 | 54 | 54 | 34 | 3.0 | 9 | 0.15 | 0.10 | 1.5 | $7.0 \times 10^{10}$ |
| 55 | 55 | 55 | 20 | 1.6 | 8 | 0.20 | 0.20 | 1.0 | $2.3 \times 10^{12}$ |
| 56 | 56 | 56 | 34 | 1.8 | 5 | 0.20 | 0.20 | 1.0 | $8.0 \times 10^{10}$ |
| 57 | 57 | 57 | 34 | 3.0 | 9 | 0.20 | 0.20 | 1.0 | $7.3 \times 10^{10}$ |
| 58 | 58 | 58 | 47 | 4.8 | 10 | 0.20 | 0.20 | 1.0 | $5.8 \times 10^{8}$ |
| 59 | 59 | 59 | 33 | 4.8 | 15 | 0.20 | 0.20 | 1.0 | $9.5 \times 10^{10}$ |
| 60 | 60 | 60 | 32 | 8.4 | 26 | 0.20 | 0.20 | 1.0 | $1.5 \times 10^{11}$ |
| 61 | 61 | 61 | 45 | 9.2 | 20 | 0.20 | 0.20 | 1.0 | $7.0 \times 10^{10}$ |
| 62 | 62 | 62 | 44 | 13.1 | 30 | 0.20 | 0.20 | 1.0 | $9.2 \times 10^{10}$ |
| 63 | 63 | 63 | 34 | 3.0 | 9 | 0.45 | 0.20 | 2.3 | $6.6 \times 10^{10}$ |
| 64 | 64 | 64 | 34 | 3.0 | 9 | 0.45 | 0.40 | 1.1 | $6.6 \times 10^{10}$ |
| 65 | 65 | 65 | 34 | 3.0 | 9 | 0.15 | 0.15 | 1.0 | $6.6 \times 10^{10}$ |
| 66 | 66 | 66 | 34 | 3.0 | 9 | 0.15 | 0.10 | 1.5 | $6.6 \times 10^{10}$ |
| 67 | 67 | 67 | 20 | 1.4 | 7 | 0.20 | 0.20 | 1.0 | $1.5 \times 10^{12}$ |
| 68 | 68 | 68 | 21 | 4.3 | 20 | 0.20 | 0.20 | 1.0 | $2.0 \times 10^{12}$ |
| 69 | 69 | 69 | 21 | 6.2 | 30 | 0.20 | 0.20 | 1.0 | $2.5 \times 10^{12}$ |
| 70 | 70 | 70 | 35 | 0.22 | 0.6 | 0.20 | 0.20 | 1.0 | $5.5 \times 10^{10}$ |
| 71 | 71 | 71 | 34 | 3.0 | 9 | 0.20 | 0.20 | 1.0 | $6.0 \times 10^{10}$ |
| 72 | 72 | 72 | 48 | 4.9 | 10 | 0.20 | 0.20 | 1.0 | $4.2 \times 10^{8}$ |
| 73 | 73 | 73 | 49 | 2.5 | 5 | 0.20 | 0.20 | 1.0 | $4.0 \times 10^{8}$ |
| 74 | 74 | 74 | 33 | 4.9 | 15 | 0.20 | 0.20 | 1.0 | $6.2 \times 10^{10}$ |
| 75 | 75 | 75 | 32 | 8.4 | 26 | 0.20 | 0.20 | 1.0 | $6.8 \times 10^{10}$ |
| 76 | 76 | 76 | 45 | 9.2 | 20 | 0.20 | 0.20 | 1.0 | $1.4 \times 10^{9}$ |
| 77 | 77 | 77 | 44 | 13.1 | 30 | 0.20 | 0.20 | 1.0 | $2.2 \times 10^{9}$ |
| 78 | 78 | 78 | 34 | 1.8 | 5 | 0.45 | 0.20 | 2.3 | $5.0 \times 10^{10}$ |

TABLE 7-continued

Table 7

| Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 79 | 79 | 79 | 34 | 1.8 | 5 | 0.45 | 0.40 | 1.1 | $5.0 \times 10^{10}$ |
| 80 | 80 | 80 | 34 | 1.8 | 5 | 0.15 | 0.15 | 1.0 | $5.0 \times 10^{10}$ |
| 81 | 81 | 81 | 34 | 1.8 | 5 | 0.15 | 0.10 | 1.5 | $5.0 \times 10^{10}$ |
| 82 | 82 | 82 | 34 | 3.0 | 9 | 0.20 | 0.20 | 1.0 | $2.4 \times 10^{9}$ |
| 83 | 83 | 83 | 34 | 3.0 | 9 | 0.20 | 0.20 | 1.0 | $3.0 \times 10^{11}$ |
| 84 | 84 | 84 | 21 | 3.4 | 7 | 0.20 | 0.20 | 1.0 | $1.0 \times 10^{12}$ |
| 85 | 85 | 85 | 20 | 1.6 | 8 | 0.20 | 0.20 | 1.0 | $2.2 \times 10^{12}$ |
| 86 | 86 | 86 | 34 | 1.8 | 5 | 0.20 | 0.20 | 1.0 | $6.1 \times 10^{12}$ |
| 87 | 87 | 87 | 34 | 3.0 | 9 | 0.20 | 0.20 | 1.0 | $6.7 \times 10^{10}$ |
| 88 | 88 | 88 | 47 | 4.8 | 10 | 0.20 | 0.20 | 1.0 | $5.0 \times 10^{8}$ |
| 89 | 89 | 89 | 20 | 1.6 | 8 | 0.20 | 0.20 | 1.0 | $2.4 \times 10^{12}$ |
| 90 | 90 | 90 | 34 | 1.8 | 5 | 0.20 | 0.20 | 1.0 | $6.6 \times 10^{10}$ |
| 91 | 91 | 91 | 34 | 3.0 | 9 | 0.20 | 0.20 | 1.0 | $7.0 \times 10^{10}$ |
| 92 | 92 | 92 | 47 | 4.8 | 10 | 0.20 | 0.20 | 1.0 | $5.2 \times 10^{8}$ |
| 93 | 93 | 93 | 20 | 1.6 | 8 | 0.20 | 0.20 | 1.0 | $3.2 \times 10^{12}$ |
| 94 | 94 | 94 | 34 | 1.8 | 5 | 0.20 | 0.20 | 1.0 | $7.4 \times 10^{10}$ |
| 95 | 95 | 95 | 34 | 3.0 | 9 | 0.20 | 0.20 | 1.0 | $8.0 \times 10^{10}$ |
| 96 | 96 | 96 | 48 | 4.9 | 10 | 0.20 | 0.20 | 1.0 | $6.0 \times 10^{8}$ |
| 97 | 97 | 97 | 21 | 1.7 | 8 | 0.20 | 0.20 | 1.0 | $2.6 \times 10^{12}$ |
| 98 | 98 | 98 | 35 | 1.9 | 5 | 0.20 | 0.20 | 1.0 | $6.6 \times 10^{10}$ |
| 99 | 99 | 99 | 34 | 3.0 | 9 | 0.20 | 0.20 | 1.0 | $7.2 \times 10^{10}$ |
| 100 | 100 | 100 | 48 | 4.9 | 10 | 0.20 | 0.20 | 1.0 | $5.4 \times 10^{8}$ |

TABLE 8

Table 8

| Comparative Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 1 | C1 | C1 | 15 | 1.6 | 11 | 0.20 | 0.20 | 1.0 | $5.3 \times 10^{12}$ |
| 2 | C2 | C2 | 52 | 4.8 | 9 | 0.20 | 0.20 | 1.0 | $2.5 \times 10^{8}$ |
| 3 | C3 | C3 | 35 | — | — | 0.20 | — | — | $3.0 \times 10^{10}$ |
| 4 | C4 | C4 | 35 | 0.06 | 0.1 | 0.20 | 0.20 | 1.0 | $3.0 \times 10^{10}$ |
| 5 | C5 | C5 | 49 | 0.05 | 0.1 | 0.20 | 0.20 | 1.0 | $5.0 \times 10^{8}$ |
| 6 | C6 | C6 | 28 | 20.0 | 71 | 0.20 | 0.20 | 1.0 | $8.0 \times 10^{10}$ |
| 7 | C7 | C7 | 40 | 20.2 | 51 | 0.20 | 0.20 | 1.0 | $9.0 \times 10^{8}$ |
| 8 | C8 | C8 | 35 | 0.13 | 0.4 | 0.20 | 0.20 | 1.0 | $3.5 \times 10^{10}$ |
| 9 | C9 | C9 | 31 | 10.7 | 35 | 0.20 | 0.20 | 1.0 | $8.0 \times 10^{10}$ |
| 10 | C10 | C10 | 15 | 1.6 | 11 | 0.20 | 0.20 | 1.0 | $6.0 \times 10^{12}$ |
| 11 | C11 | C11 | 52 | 4.8 | 9 | 0.20 | 0.20 | 1.0 | $3.0 \times 10^{8}$ |
| 12 | C12 | C12 | 35 | — | — | 0.20 | — | — | $3.5 \times 10^{10}$ |
| 13 | C13 | C13 | 35 | 0.05 | 0.1 | 0.20 | 0.20 | 1.0 | $3.5 \times 10^{10}$ |
| 14 | C14 | C14 | 40 | 20.2 | 51 | 0.20 | 0.20 | 1.0 | $5.7 \times 10^{8}$ |
| 15 | C15 | C15 | 35 | 0.13 | 0.4 | 0.20 | 0.20 | 1.0 | $8.4 \times 10^{10}$ |
| 16 | C16 | C16 | 31 | 10.8 | 35 | 0.20 | 0.20 | 1.0 | $9.5 \times 10^{8}$ |
| 17 | C17 | C17 | 14 | 1.4 | 10 | 0.20 | 0.20 | 1.0 | $5.8 \times 10^{12}$ |
| 18 | C18 | C18 | 52 | 4.8 | 9 | 0.20 | 0.20 | 1.0 | $2.7 \times 10^{8}$ |
| 19 | C19 | C19 | 35 | 0 | 0 | 0.20 | 0.20 | 1.0 | $3.3 \times 10^{10}$ |
| 20 | C20 | C20 | 35 | 0.05 | 0.1 | 0.20 | 0.20 | 1.0 | $3.3 \times 10^{10}$ |
| 21 | C21 | C21 | 40 | 20.1 | 50 | 0.20 | 0.20 | 1.0 | $5.5 \times 10^{8}$ |
| 22 | C22 | C22 | 35 | 0.14 | 0.4 | 0.20 | 0.20 | 1.0 | $8.1 \times 10^{10}$ |
| 23 | C23 | C23 | 31 | 10.9 | 35 | 0.20 | 0.20 | 1.0 | $9.0 \times 10^{8}$ |
| 24 | C24 | C24 | 15 | 1.6 | 11 | 0.20 | 0.20 | 1.0 | $6.3 \times 10^{12}$ |
| 25 | C25 | C25 | 52 | 4.8 | 9 | 0.20 | 0.20 | 1.0 | $3.4 \times 10^{8}$ |
| 26 | C26 | C26 | 35 | — | — | 0.20 | — | — | $3.7 \times 10^{10}$ |
| 27 | C27 | C27 | 35 | 0.05 | 0.1 | 0.20 | 0.20 | 1.0 | $3.7 \times 10^{10}$ |
| 28 | C28 | C28 | 40 | 20.2 | 51 | 0.20 | 0.20 | 1.0 | $6.0 \times 10^{8}$ |
| 29 | C29 | C29 | 35 | 0.14 | 0.4 | 0.20 | 0.20 | 1.0 | $8.6 \times 10^{10}$ |
| 30 | C30 | C30 | 31 | 10.9 | 35 | 0.20 | 0.20 | 1.0 | $9.7 \times 10^{8}$ |
| 31 | C31 | C31 | 15 | 1.5 | 10 | 0.20 | 0.20 | 1.0 | $6.1 \times 10^{12}$ |
| 32 | C32 | C32 | 52 | 4.8 | 9 | 0.20 | 0.20 | 1.1 | $3.3 \times 10^{8}$ |
| 33 | C33 | C33 | 35 | — | — | 0.20 | — | 1.0 | $3.6 \times 10^{10}$ |
| 34 | C34 | C34 | 35 | 0.05 | 0.1 | 0.20 | 0.20 | 1.0 | $3.6 \times 10^{10}$ |
| 35 | C35 | C35 | 40 | 20.2 | 51 | 0.20 | 0.20 | 1.0 | $5.6 \times 10^{8}$ |
| 36 | C36 | C36 | 35 | 0.13 | 0.4 | 0.20 | 0.20 | 1.0 | $8.4 \times 10^{10}$ |

TABLE 8-continued

Table 8

| Comparative Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 37 | C37 | C37 | 31 | 10.8 | 35 | 0.20 | 0.20 | 1.0 | $9.4 \times 10^{8}$ |
| 38 | C38 | C38 | 34 | 4.8 | 14 | 0.20 | 0.20 | 1.0 | $6.7 \times 10^{10}$ |
| 39 | C39 | C39 | 33 | 4.8 | 15 | 0.20 | 0.20 | 1.0 | $6.9 \times 10^{10}$ |
| 40 | C40 | C40 | 25 | — | — | 0.02 | — | — | $3.0 \times 10^{9}$ |
| 41 | C41 | C41 | 35 | — | — | 0.20 | — | — | $1.0 \times 10^{14}$ |
| 42 | C42 | C42 | 20 | 20 | 1 | 0.20 | 0.20 | 1.0 | $1.0 \times 10^{14}$ |

TABLE 9

Table 9

| Comparative Example | Conductive layer-forming coating solution | Electrophotographic photosensitive member | Content of first metal oxide particles (vol %) | Content of second metal oxide particles (vol %) | Content of second metal oxide particles based on first metal oxide particles (vol %) | $D_1$ (μm) | $D_2$ (μm) | $D_1/D_2$ | Volume resistivity of conductive layer (Ω · cm) |
|---|---|---|---|---|---|---|---|---|---|
| 43 | C43 | C43 | 15 | 1.5 | 10 | 0.20 | 0.20 | 1.0 | $5.0 \times 10^{12}$ |
| 44 | C44 | C44 | 54 | 5.0 | 9 | 0.20 | 0.20 | 1.0 | $2.0 \times 10^{8}$ |
| 45 | C45 | C45 | 35 | — | — | 0.20 | — | — | $2.8 \times 10^{10}$ |
| 46 | C46 | C46 | 35 | 0.05 | 0.1 | 0.20 | 0.20 | 1.0 | $2.8 \times 10^{10}$ |
| 47 | C47 | C47 | 40 | 20.2 | 51 | 0.20 | 0.20 | 1.0 | $7.5 \times 10^{8}$ |
| 48 | C48 | C48 | 35 | 0.1 | 0.3 | 0.20 | 0.20 | 1.0 | $3.2 \times 10^{10}$ |
| 49 | C49 | C49 | 31 | 11.3 | 36 | 0.20 | 0.20 | 1.0 | $7.7 \times 10^{10}$ |
| 50 | C50 | C50 | 14 | 1.6 | 11 | 0.20 | 0.20 | 1.0 | $5.4 \times 10^{12}$ |
| 51 | C51 | C51 | 53 | 4.9 | 9 | 0.20 | 0.20 | 1.0 | $2.3 \times 10^{8}$ |
| 52 | C52 | C52 | 35 | — | — | 0.20 | — | — | $3.2 \times 10^{10}$ |
| 53 | C53 | C53 | 35 | 0.05 | 0.1 | 0.20 | 0.20 | 1.0 | $3.2 \times 10^{10}$ |
| 54 | C54 | C54 | 40 | 20.2 | 51 | 0.20 | 0.20 | 1.0 | $7.9 \times 10^{8}$ |
| 55 | C55 | C55 | 35 | 0.1 | 0.3 | 0.20 | 0.20 | 1.0 | $3.5 \times 10^{10}$ |
| 56 | C56 | C56 | 31 | 10.9 | 35 | 0.20 | 0.20 | 1.0 | $8.0 \times 10^{10}$ |
| 57 | C57 | C57 | 15 | 1.5 | 10 | 0.20 | 0.20 | 1.0 | $5.0 \times 10^{12}$ |
| 58 | C58 | C58 | 53 | 5.0 | 9 | 0.20 | 0.20 | 1.0 | $2.0 \times 10^{8}$ |
| 59 | C59 | C59 | 35 | — | — | 0.20 | — | — | $3.0 \times 10^{10}$ |
| 60 | C60 | C60 | 35 | 0.05 | 0.1 | 0.20 | 0.20 | 1.0 | $3.0 \times 10^{10}$ |
| 61 | C61 | C61 | 40 | 20.2 | 51 | 0.20 | 0.20 | 1.0 | $7.6 \times 10^{8}$ |
| 62 | C62 | C62 | 35 | 0.1 | 0.3 | 0.20 | 0.20 | 1.0 | $3.3 \times 10^{10}$ |
| 63 | C63 | C63 | 31 | 10.9 | 35 | 0.20 | 0.20 | 1.0 | $7.7 \times 10^{10}$ |
| 64 | C64 | C64 | 14 | 1.5 | 11 | 0.20 | 0.20 | 1.0 | $5.8 \times 10^{12}$ |
| 65 | C65 | C65 | 53 | 4.9 | 9 | 0.20 | 0.20 | 1.0 | $2.6 \times 10^{8}$ |
| 66 | C66 | C66 | 35 | — | — | 0.20 | — | — | $3.8 \times 10^{10}$ |
| 67 | C67 | C67 | 35 | 0.05 | 0.1 | 0.20 | 0.20 | 1.0 | $3.8 \times 10^{10}$ |
| 68 | C68 | C68 | 40 | 20.2 | 51 | 0.20 | 0.20 | 1.0 | $8.5 \times 10^{8}$ |
| 69 | C69 | C69 | 35 | 0.1 | 0.3 | 0.20 | 0.20 | 1.0 | $4.0 \times 10^{10}$ |
| 70 | C70 | C70 | 31 | 10.9 | 35 | 0.20 | 0.20 | 1.0 | $8.6 \times 10^{10}$ |
| 71 | C71 | C71 | 14 | 1.5 | 11 | 0.20 | 0.20 | 1.0 | $5.6 \times 10^{12}$ |
| 72 | C72 | C72 | 53 | 4.9 | 9 | 0.20 | 0.20 | 1.0 | $2.5 \times 10^{8}$ |
| 73 | C73 | C73 | 35 | — | — | 0.20 | — | — | $3.5 \times 10^{10}$ |
| 74 | C74 | C74 | 35 | 0.05 | 0.1 | 0.20 | 0.20 | 1.0 | $3.5 \times 10^{10}$ |
| 75 | C75 | C75 | 40 | 20.3 | 51 | 0.20 | 0.20 | 1.0 | $8.2 \times 10^{8}$ |
| 76 | C76 | C76 | 35 | 0.1 | 0.3 | 0.20 | 0.20 | 1.0 | $3.8 \times 10^{10}$ |
| 77 | C77 | C77 | 31 | 11.0 | 35 | 0.20 | 0.20 | 1.0 | $8.3 \times 10^{10}$ |
| 78 | C78 | C78 | 35 | — | — | 0.15 | — | — | $3.5 \times 10^{10}$ |
| 79 | C79 | C79 | 29 | — | — | 0.15 | — | — | $2.0 \times 10^{13}$ |
| 80 | C80 | C80 | 37 | — | — | 0.08 | — | — | $3.5 \times 10^{10}$ |
| 81 | C81 | C81 | 32 | — | — | 0.35 | — | — | $2.1 \times 10^{9}$ |
| 82 | C82 | C82 | 32 | — | — | 0.38 | — | — | $4.0 \times 10^{9}$ |

Repeated Printing Test of Electrophotographic Photosensitive Member

Each of the electrophotographic photosensitive members 1 to 100 and C1 to C82 for a repeated printing test was set in a laser beam printer (trade name: LBP7200C) manufactured by CANON KABUSHIKI KAISHA. Subsequently, a repeated printing test was performed in a low-temperature and low-humidity environment (15° C./10% RH), and the image was evaluated. In the repeated printing test, printing was performed in an intermittent mode in which a text image with a printing ratio of 2% was successively output on a single sheet of letter paper, and 3000 sheets were printed.

A sample sheet for image evaluation (a halftone image with a similar knight jump pattern) was printed before the repeated printing test, after the printing of 1500 sheets, and after the printing of 3000 sheets. The criteria of the image evaluation are as follows.

A: Image defects due to the generation of leakage are not observed on an image.

B: Small black spots due to the generation of leakage are observed on an image.

C: Large black spots due to the generation of leakage are observed on an image.

D: Large black spots and horizontal short black streaks due to the generation of leakage are observed on an image.

E: Horizontal long black streaks due to the generation of leakage are observed on an image.

Before the repeated printing test and after the printing of 3000 sheets, the charge potential (dark-area potential) and the potential upon exposure (light-area potential) were measured after the sample sheet for image evaluation was printed. The potentials were measured using a single sheet with a solid white image and a single sheet with a solid black image. The initial dark-area potential (before the repeated printing test) was assumed to be Vd and the initial light-area potential (before the repeated printing test) was assumed to be Vl'. The dark-area potential after the printing of 3000 sheets was assumed to be Vd' and the light-area potential after the printing of 3000 sheets was assumed to be Vl'. A dark-area potential difference ΔVd (=|Vd'|−|Vd|), which was a difference between the dark-area potential Vd' after the printing of 3000 sheets and the initial dark-area potential Vd, was determined. A light-area potential difference ΔVl (=|Vl'|−|Vl|), which was a difference between the light-area potential Vl' after the printing of 3000 sheets and the initial light-area potential Vl, was determined. Tables 10 and 11 show the results.

TABLE 10

Table 10

| Example | Electrophotographic photosensitive member | Leakage: Before printing test | Leakage: After printing of 1500 sheets | Leakage: After printing of 3000 sheets | Potential difference [V] ΔVd | Potential difference [V] ΔVl |
|---|---|---|---|---|---|---|
| 1 | 1 | A | A | A | +10 | +10 |
| 2 | 2 | A | A | A | +12 | +30 |
| 3 | 3 | A | A | A | +15 | +35 |
| 4 | 4 | A | B | B | +6 | +15 |
| 5 | 5 | A | A | A | +10 | +10 |
| 6 | 6 | A | A | B | +8 | +10 |
| 7 | 7 | A | A | B | +6 | +10 |
| 8 | 8 | A | A | A | +10 | +20 |
| 9 | 9 | A | A | A | +10 | +30 |
| 10 | 10 | A | A | A | +8 | +20 |
| 11 | 11 | A | A | A | +10 | +35 |
| 12 | 12 | A | A | A | +10 | +10 |
| 13 | 13 | A | A | A | +10 | +10 |
| 14 | 14 | A | A | A | +10 | +10 |
| 15 | 15 | A | A | A | +10 | +10 |
| 16 | 16 | A | A | A | +8 | +10 |
| 17 | 17 | A | A | A | +10 | +10 |
| 18 | 18 | A | A | A | +12 | +10 |
| 19 | 19 | A | A | A | +12 | +10 |
| 20 | 20 | A | A | A | +10 | +10 |
| 21 | 21 | A | A | A | +10 | +10 |
| 22 | 22 | A | A | B | +10 | +15 |
| 23 | 23 | A | A | A | +10 | +20 |
| 24 | 24 | A | A | A | +12 | +30 |
| 25 | 25 | A | A | A | +10 | +30 |
| 26 | 26 | A | A | A | +15 | +35 |
| 27 | 27 | A | A | A | +10 | +20 |
| 28 | 28 | A | A | A | +10 | +20 |
| 29 | 29 | A | A | A | +10 | +20 |
| 30 | 30 | A | A | A | +10 | +20 |
| 31 | 31 | A | A | A | +10 | +20 |

TABLE 10-continued

Table 10

| Example | Electrophotographic photosensitive member | Leakage: Before printing test | Leakage: After printing of 1500 sheets | Leakage: After printing of 3000 sheets | Potential difference [V] ΔVd | Potential difference [V] ΔVl |
|---|---|---|---|---|---|---|
| 32 | 32 | A | A | A | +10 | +20 |
| 33 | 33 | A | A | A | +10 | +20 |
| 34 | 34 | A | A | B | +6 | +10 |
| 35 | 35 | A | A | A | +10 | +20 |
| 36 | 36 | A | A | A | +12 | +35 |
| 37 | 37 | A | A | A | +10 | +30 |
| 38 | 38 | A | A | A | +15 | +35 |
| 39 | 39 | A | A | A | +10 | +10 |
| 40 | 40 | A | A | A | +10 | +10 |
| 41 | 41 | A | A | A | +10 | +10 |
| 42 | 42 | A | A | A | +10 | +10 |
| 43 | 43 | A | A | A | +10 | +15 |
| 44 | 44 | A | A | B | +8 | +10 |
| 45 | 45 | A | A | A | +10 | +10 |
| 46 | 46 | A | A | B | +8 | +10 |
| 47 | 47 | A | A | A | +10 | +20 |
| 48 | 48 | A | A | A | +14 | +35 |
| 49 | 49 | A | A | A | +12 | +30 |
| 50 | 50 | A | A | A | +15 | +35 |
| 51 | 51 | A | A | A | +10 | +20 |
| 52 | 52 | A | A | A | +10 | +20 |
| 53 | 53 | A | A | A | +10 | +20 |
| 54 | 54 | A | A | A | +10 | +20 |
| 55 | 55 | A | A | A | +13 | +30 |
| 56 | 56 | A | A | A | +10 | +20 |
| 57 | 57 | A | A | A | +10 | +20 |
| 58 | 58 | A | A | B | +6 | +15 |
| 59 | 59 | A | A | A | +10 | +20 |
| 60 | 60 | A | A | A | +15 | +30 |
| 61 | 61 | A | A | A | +12 | +30 |
| 62 | 62 | A | A | A | +15 | +35 |
| 63 | 63 | A | A | A | +10 | +20 |
| 64 | 64 | A | A | A | +10 | +20 |
| 65 | 65 | A | A | A | +10 | +20 |
| 66 | 66 | A | A | A | +10 | +20 |
| 67 | 67 | A | A | A | +10 | +20 |
| 68 | 68 | A | A | A | +15 | +30 |
| 69 | 69 | A | A | A | +15 | +35 |
| 70 | 70 | A | B | B | +6 | +20 |
| 71 | 71 | A | A | A | +10 | +20 |
| 72 | 72 | A | A | A | +6 | +15 |
| 73 | 73 | A | A | B | +6 | +12 |
| 74 | 74 | A | A | A | +10 | +20 |
| 75 | 75 | A | A | A | +15 | +35 |
| 76 | 76 | A | A | A | +13 | +30 |
| 77 | 77 | A | A | A | +15 | +35 |
| 78 | 78 | A | A | A | +10 | +20 |
| 79 | 79 | A | A | A | +10 | +20 |
| 80 | 80 | A | A | A | +10 | +20 |
| 81 | 81 | A | A | A | +10 | +20 |
| 82 | 82 | A | A | A | +8 | +20 |
| 83 | 83 | A | A | A | +10 | +20 |
| 84 | 84 | A | A | A | +12 | +20 |
| 85 | 85 | A | A | A | +12 | +20 |
| 86 | 86 | A | A | A | +10 | +20 |
| 87 | 87 | A | A | A | +10 | +20 |
| 88 | 88 | A | A | B | +6 | +14 |
| 89 | 89 | A | A | A | +12 | +20 |
| 90 | 90 | A | A | A | +12 | +20 |
| 91 | 91 | A | A | A | +10 | +20 |
| 92 | 92 | A | A | B | +8 | +10 |
| 93 | 93 | A | A | A | +12 | +20 |
| 94 | 94 | A | A | A | +10 | +20 |
| 95 | 95 | A | A | A | +10 | +20 |
| 96 | 96 | A | A | B | +6 | +20 |
| 97 | 97 | A | A | A | +12 | +20 |
| 98 | 98 | A | A | A | +10 | +20 |
| 99 | 99 | A | A | A | +10 | +20 |
| 100 | 100 | A | A | B | +6 | +10 |

TABLE 11

Table 11

| Comparative Example | Electrophotographic photosensitive member | Leakage: Before printing test | Leakage: After printing of 1500 sheets | Leakage: After printing of 3000 sheets | Potential difference [V] ΔVd | Potential difference [V] ΔVI |
|---|---|---|---|---|---|---|
| 1 | C1 | A | A | A | +20 | +80 |
| 2 | C2 | A | B | C | +10 | +30 |
| 3 | C3 | A | B | C | +15 | +30 |
| 4 | C4 | A | B | C | +10 | +30 |
| 5 | C5 | C | D | E | +10 | +20 |
| 6 | C6 | A | A | A | +30 | +90 |
| 7 | C7 | A | A | A | +25 | +70 |
| 8 | C8 | A | B | C | +15 | +20 |
| 9 | C9 | A | A | A | +25 | +70 |
| 10 | C10 | A | A | A | +20 | +90 |
| 11 | C11 | A | C | C | +10 | +30 |
| 12 | C12 | B | B | D | +15 | +30 |
| 13 | C13 | A | B | C | +10 | +30 |
| 14 | C14 | A | A | A | +25 | +80 |
| 15 | C15 | A | A | C | +15 | +20 |
| 16 | C16 | A | A | A | +25 | +70 |
| 17 | C17 | A | A | A | +20 | +90 |
| 18 | C18 | B | C | C | +10 | +30 |
| 19 | C19 | B | B | C | +15 | +30 |
| 20 | C20 | A | B | C | +10 | +30 |
| 21 | C21 | A | A | A | +25 | +80 |
| 22 | C22 | A | B | C | +15 | +20 |
| 23 | C23 | A | A | A | +25 | +70 |
| 24 | C24 | A | A | A | +20 | +100 |
| 25 | C25 | B | C | C | +10 | +30 |
| 26 | C26 | B | B | C | +15 | +30 |
| 27 | C27 | B | B | C | +10 | +30 |
| 28 | C28 | A | A | A | +25 | +80 |
| 29 | C29 | A | B | C | +15 | +20 |
| 30 | C30 | A | A | A | +25 | +70 |
| 31 | C31 | A | A | A | +20 | +90 |
| 32 | C32 | B | C | C | +10 | +40 |
| 33 | C33 | B | B | C | +15 | +40 |
| 34 | C34 | B | B | C | +10 | +30 |
| 35 | C35 | A | A | A | +25 | +80 |
| 36 | C36 | A | B | C | +15 | +20 |
| 37 | C37 | A | A | A | +25 | +70 |
| 38 | C38 | A | A | B | +20 | +50 |
| 39 | C39 | A | A | B | +20 | +60 |
| 40 | C40 | C | D | E | +6 | +10 |
| 41 | C41 | A | A | A | +30 | +120 |
| 42 | C42 | A | A | A | +30 | +110 |
| 43 | C43 | A | A | A | +25 | +90 |
| 44 | C44 | A | B | C | +10 | +30 |
| 45 | C45 | A | B | C | +15 | +40 |
| 46 | C46 | A | B | C | +10 | +30 |
| 47 | C47 | A | A | A | +25 | +80 |
| 48 | C48 | B | B | C | +15 | +20 |
| 49 | C49 | A | A | A | +25 | +60 |
| 50 | C50 | A | A | A | +20 | +80 |
| 51 | C51 | A | B | C | +10 | +30 |
| 52 | C52 | A | B | C | +15 | +30 |
| 53 | C53 | A | B | C | +10 | +30 |
| 54 | C54 | A | A | A | +20 | +70 |
| 55 | C55 | B | B | C | +15 | +20 |
| 56 | C56 | A | A | A | +25 | +70 |
| 57 | C57 | A | A | A | +30 | +90 |
| 58 | C58 | B | B | C | +10 | +40 |
| 59 | C59 | B | B | D | +20 | +40 |
| 60 | C60 | A | B | C | +10 | +30 |
| 61 | C61 | A | A | A | +30 | +80 |
| 62 | C62 | B | B | C | +20 | +40 |
| 63 | C63 | A | A | A | +30 | +70 |
| 64 | C64 | A | A | A | +25 | +80 |
| 65 | C65 | A | B | C | +10 | +60 |
| 66 | C66 | B | B | C | +20 | +30 |
| 67 | C67 | A | B | C | +10 | +30 |
| 68 | C68 | A | A | A | +30 | +80 |
| 69 | C69 | B | B | C | +20 | +40 |
| 70 | C70 | A | A | A | +25 | +60 |

TABLE 11-continued

Table 11

| Comparative Example | Electrophotographic photosensitive member | Leakage: Before printing test | Leakage: After printing of 1500 sheets | Leakage: After printing of 3000 sheets | Potential difference [V] ΔVd | Potential difference [V] ΔVI |
|---|---|---|---|---|---|---|
| 71 | C71 | A | A | A | +30 | +100 |
| 72 | C72 | A | B | C | +20 | +80 |
| 73 | C73 | B | B | C | +20 | +30 |
| 74 | C74 | B | B | C | +15 | +40 |
| 75 | C75 | A | A | A | +30 | +110 |
| 76 | C76 | A | B | C | +25 | +60 |
| 77 | C77 | A | A | A | +25 | +60 |
| 78 | C78 | A | B | B | +10 | +15 |
| 79 | C79 | A | B | B | +10 | +25 |
| 80 | C80 | A | B | C | +15 | +30 |
| 81 | C81 | A | B | B | +10 | +20 |
| 82 | C82 | A | B | B | +10 | +20 |

Needle Withstand Voltage Test of Electrophotographic Photosensitive Member

A needle withstand voltage test was performed as follows using the electrophotographic photosensitive members 101 to 200 and C101 to C182 for a needle withstand voltage test.

Figure 2:
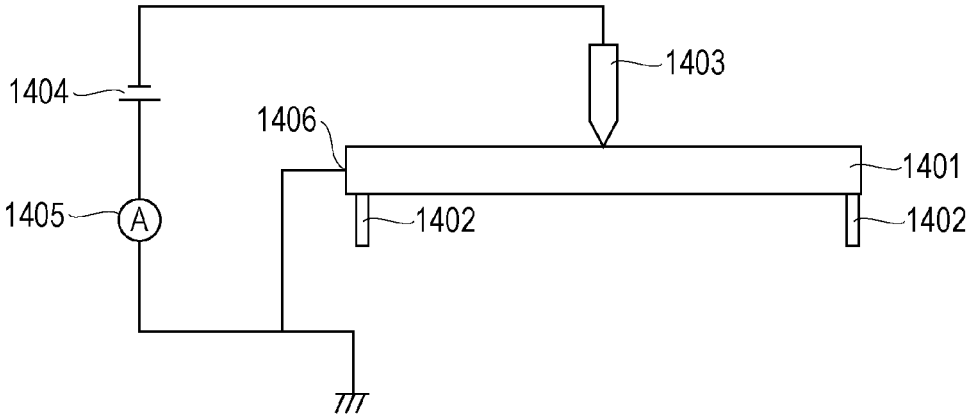
FIG. 2 illustrates an example of a needle withstand voltage tester.

FIG. 2 illustrates a needle withstand voltage tester. The needle withstand voltage test was performed in an ordinary-temperature and ordinary-humidity environment (23° C./50% RH).

Both ends of an electrophotographic photosensitive member 1401 were placed on fixing stages 1402 so that the electrophotographic photosensitive member 1401 was fixed. A tip of a needle electrode 1403 was brought into contact with the surface of the electrophotographic photosensitive member 1401. A power supply 1404 for applying a voltage and an ammeter 1405 for measuring an electric current were connected to the needle electrode 1403. A portion 1406 that contacts a support of the electrophotographic photosensitive member 1401 was connected to the ground. A voltage applied from the needle electrode 1403 for two seconds was increased from 0 V in increments of 10 V. A voltage at which leakage occurred inside the electrophotographic photosensitive member 1401 that was in contact with the tip of the needle electrode 1403 and a value indicated by the ammeter 1405 exceeded 10 times the original value was defined as a needle withstand voltage. This measurement was performed in five portions of the surface of the electrophotographic photosensitive member 1401, and the average of the five voltages was defined as a needle withstand voltage of the measured electrophotographic photosensitive member 1401. Tables 12 and 13 show the results.

TABLE 12

Table 12

| Example | Electrophotographic photosensitive member | Needle withstand voltage [−V] |
|---|---|---|
| 1 | 101 | 4500 |
| 2 | 102 | 4500 |
| 3 | 103 | 4700 |
| 4 | 104 | 3200 |
| 5 | 105 | 4000 |
| 6 | 106 | 3500 |
| 7 | 107 | 3500 |

TABLE 12-continued

Table 12

| Example | Electrophotographic photosensitive member | Needle withstand voltage [−V] |
|---|---|---|
| 8 | 108 | 4000 |
| 9 | 109 | 4000 |
| 10 | 110 | 3800 |
| 11 | 111 | 4000 |
| 12 | 112 | 4200 |
| 13 | 113 | 4200 |
| 14 | 114 | 4200 |
| 15 | 115 | 4200 |
| 16 | 116 | 4000 |
| 17 | 117 | 4200 |
| 18 | 118 | 4500 |
| 19 | 119 | 4500 |
| 20 | 120 | 4200 |
| 21 | 121 | 4200 |
| 22 | 122 | 3800 |
| 23 | 123 | 4200 |
| 24 | 124 | 4500 |
| 25 | 125 | 4200 |
| 26 | 126 | 4200 |
| 27 | 127 | 4200 |
| 28 | 128 | 4200 |
| 29 | 129 | 4200 |
| 30 | 130 | 4200 |
| 31 | 131 | 4500 |
| 32 | 132 | 4200 |
| 33 | 133 | 4200 |
| 34 | 134 | 3500 |
| 35 | 135 | 4200 |
| 36 | 136 | 4200 |
| 37 | 137 | 4200 |
| 38 | 138 | 4200 |
| 39 | 139 | 4200 |
| 40 | 140 | 4200 |
| 41 | 141 | 4200 |
| 42 | 142 | 4200 |
| 43 | 143 | 4500 |
| 44 | 144 | 3500 |
| 45 | 145 | 4200 |
| 46 | 146 | 3500 |
| 47 | 147 | 4500 |
| 48 | 148 | 4500 |
| 49 | 149 | 4200 |
| 50 | 150 | 4200 |
| 51 | 151 | 4200 |
| 52 | 152 | 4200 |
| 53 | 153 | 4200 |
| 54 | 154 | 4200 |
| 55 | 155 | 4500 |
| 56 | 156 | 4200 |
| 57 | 157 | 4200 |
| 58 | 158 | 3500 |
| 59 | 159 | 4200 |
| 60 | 160 | 4200 |
| 61 | 161 | 4200 |
| 62 | 162 | 4200 |
| 63 | 163 | 4200 |
| 64 | 164 | 4200 |
| 65 | 165 | 4200 |
| 66 | 166 | 4200 |
| 67 | 167 | 4500 |
| 68 | 168 | 4500 |
| 69 | 169 | 4700 |
| 70 | 170 | 3200 |
| 71 | 171 | 4200 |
| 72 | 172 | 3800 |
| 73 | 173 | 3500 |
| 74 | 174 | 4200 |
| 75 | 175 | 4200 |
| 76 | 176 | 3800 |
| 77 | 177 | 3800 |
| 78 | 178 | 4000 |
| 79 | 179 | 4000 |
| 80 | 180 | 4000 |

TABLE 12-continued

Table 12

| Example | Electrophotographic photosensitive member | Needle withstand voltage [−V] |
|---|---|---|
| 81 | 181 | 4000 |
| 82 | 182 | 3800 |
| 83 | 183 | 4200 |
| 84 | 184 | 4500 |
| 85 | 185 | 4500 |
| 86 | 186 | 4000 |
| 87 | 187 | 4200 |
| 88 | 188 | 3500 |
| 89 | 189 | 4500 |
| 90 | 190 | 4200 |
| 91 | 191 | 4200 |
| 92 | 192 | 3500 |
| 93 | 193 | 4500 |
| 94 | 194 | 4200 |
| 95 | 195 | 4200 |
| 96 | 196 | 3500 |
| 97 | 197 | 4500 |
| 98 | 198 | 4200 |
| 99 | 199 | 4200 |
| 100 | 200 | 3500 |

TABLE 13

Table 13

| Comparative Example | Electrophotographic photosensitive member | Needle withstand voltage [−V] |
|---|---|---|
| 1 | C101 | 4000 |
| 2 | C102 | 2000 |
| 3 | C103 | 2200 |
| 4 | C104 | 2200 |
| 5 | C105 | 1700 |
| 6 | C106 | 3500 |
| 7 | C107 | 3500 |
| 8 | C108 | 2200 |
| 9 | C109 | 2800 |
| 10 | C110 | 4000 |
| 11 | C111 | 2000 |
| 12 | C112 | 1700 |
| 13 | C113 | 2000 |
| 14 | C114 | 3800 |
| 15 | C115 | 2500 |
| 16 | C116 | 3500 |
| 17 | C117 | 4000 |
| 18 | C118 | 2000 |
| 19 | C119 | 2000 |
| 20 | C120 | 2200 |
| 21 | C121 | 3800 |
| 22 | C122 | 2200 |
| 23 | C123 | 3500 |
| 24 | C124 | 4000 |
| 25 | C125 | 2000 |
| 26 | C126 | 2000 |
| 27 | C127 | 2200 |
| 28 | C128 | 3500 |
| 29 | C129 | 2200 |
| 30 | C130 | 3500 |
| 31 | C131 | 4000 |
| 32 | C132 | 1800 |
| 33 | C133 | 2000 |
| 34 | C134 | 2000 |
| 35 | C135 | 3800 |
| 36 | C136 | 2200 |
| 37 | C137 | 3500 |
| 38 | C138 | 3000 |
| 39 | C139 | 3000 |
| 40 | C140 | 1500 |

TABLE 13-continued

Table 13

| Comparative Example | Electrophotographic photosensitive member | Needle withstand voltage [−V] |
|---|---|---|
| 41 | C141 | 4500 |
| 42 | C142 | 4500 |
| 43 | C143 | 4000 |
| 44 | C144 | 1800 |
| 45 | C145 | 2200 |
| 46 | C146 | 2200 |
| 47 | C147 | 3800 |
| 48 | C148 | 2000 |
| 49 | C149 | 3500 |
| 50 | C150 | 4000 |
| 51 | C151 | 2000 |
| 52 | C152 | 2200 |
| 53 | C153 | 2200 |
| 54 | C154 | 3800 |
| 55 | C155 | 1800 |
| 56 | C156 | 3800 |
| 57 | C157 | 4000 |
| 58 | C158 | 2000 |
| 59 | C159 | 1800 |
| 60 | C160 | 2200 |
| 61 | C161 | 3500 |
| 62 | C162 | 2000 |
| 63 | C163 | 3500 |
| 64 | C164 | 3000 |
| 65 | C165 | 2000 |
| 66 | C166 | 2000 |
| 67 | C167 | 2000 |
| 68 | C168 | 3800 |
| 69 | C169 | 2000 |
| 70 | C170 | 3500 |
| 71 | C171 | 4000 |
| 72 | C172 | 2000 |
| 73 | C173 | 2000 |
| 74 | C174 | 1800 |
| 75 | C175 | 3800 |
| 76 | C176 | 2000 |
| 77 | C177 | 3500 |
| 78 | C178 | 2500 |
| 79 | C179 | 2800 |
| 80 | C180 | 2000 |
| 81 | C181 | 2500 |
| 82 | C182 | 2300 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-033339, filed Feb. 24, 2014 and No. 2015-007041, filed Jan. 16, 2015, which are hereby incorporated by reference herein in their entirety.

What is claimed is:

1. An electrophotographic photosensitive member comprising:

a support;

a conductive layer on the support; and a photosensitive layer on the conductive layer, wherein the conductive layer comprises:

a binder material;

a first metal oxide particle; and a second metal oxide particle, the first metal oxide particle is a zinc oxide particle coated with tin oxide doped with phosphorus, tungsten, niobium, tantalum, or fluorine, the second metal oxide particle is an uncoated zinc oxide particle, a content of the first metal oxide particle in the conductive layer is not less than 20% by volume and not more than 50% by volume based on a total volume of the conductive layer, and a content of the second metal oxide particle in the conductive layer is not less than 0.1% by volume and not more than 15% by volume based on the total volume of the conductive layer, and not less than 0.5% by volume and not more than 30% by volume based on the content of the first metal oxide particle in the conductive layer.

2. The electrophotographic photosensitive member according to claim 1, wherein the content of the second metal oxide particle in the conductive layer is not less than 1% by volume and not more than 20% by volume based on the content of the first metal oxide particle in the conductive layer.

3. The electrophotographic photosensitive member according to claim 1, wherein a ratio ($D_1/D_2$) of a volume-average particle diameter ($D_1$) of the first metal oxide particle to a volume-average particle diameter ($D_2$) of the second metal oxide particle in the conductive layer is not less than 0.7 and not more than 1.5.

4. The electrophotographic photosensitive member according to claim 3, wherein the ratio $D_1/D_2$ is not less than 1.0 and not more than 1.5.

5. The electrophotographic photosensitive member according to claim 3, wherein the volume-average particle diameter ($D_1$) of the first metal oxide particle is not less than 0.10 μm and not more than 0.45 μm.

6. The electrophotographic photosensitive member according to claim 1, wherein the binder material is a curable resin.

7. The electrophotographic photosensitive member according to claim 1, wherein a volume resistivity of the conductive layer is not less than $1.0\times10^8$ Ω·cm and not more than $5.0\times10^{12}$ Ω·cm.

8. A process cartridge detachably attachable to a main body of an electrophotographic apparatus, wherein the process cartridge integrally supports the electrophotographic photosensitive member according to claim 1 and at least one selected from the group consisting of a charging device, a developing device, a transfer device, and a cleaning member.

9. An electrophotographic apparatus comprising:

the electrophotographic photosensitive member according to claim 1;

a charging device;

an exposing device;

a developing device; and a transfer device.

10. An electrophotographic photosensitive member comprising:

a support;

a conductive layer on the support; and a photosensitive layer on the conductive layer, wherein the conductive layer comprises:

a binder material;

a first metal oxide particle; and a second metal oxide particle, the first metal oxide particle is a tin oxide particle coated with tin oxide doped with phosphorus, tungsten, niobium, tantalum, or fluorine, the second metal oxide particle is an uncoated tin oxide particle, a content of the first metal oxide particle in the conductive layer is not less than 20% by volume and not more than 50% by volume based on a total volume of the conductive layer, and a content of the second metal oxide particle in the conductive layer is not less than 0.1% by volume and not more than 15% by volume based on the total volume of the conductive layer, and not less than 0.5% by volume and not more than 30% by volume based on the content of the first metal oxide particle in the conductive layer.

11. The electrophotographic photosensitive member according to claim 10, wherein the content of the second metal oxide particle in the conductive layer is not less than 1% by volume and not more than 20% by volume based on the content of the first metal oxide particle in the conductive layer.

12. The electrophotographic photosensitive member according to claim 10, wherein a ratio ($D_1/D_2$) of a volume-average particle diameter ($D_1$) of the first metal oxide particle to a volume-average particle diameter ($D_2$) of the second metal oxide particle in the conductive layer is not less than 0.7 and not more than 1.5.

13. The electrophotographic photosensitive member according to claim 12, wherein the ratio $D_1/D_2$ is not less than 1.0 and not more than 1.5.

14. The electrophotographic photosensitive member according to claim 12, wherein the volume-average particle diameter ($D_1$) of the first metal oxide particle is not less than 0.10 μm and not more than 0.45 μm.

15. The electrophotographic photosensitive member according to claim 10, wherein the binder material is a curable resin.

16. The electrophotographic photosensitive member according to claim 10, wherein a volume resistivity of the conductive layer is not less than $1.0\times10^{8}$ Ω·cm and not more than $5.0\times10^{12}$ Ω·cm.

17. A process cartridge detachably attachable to a main body of an electrophotographic apparatus, wherein the process cartridge integrally supports the electrophotographic photosensitive member according to claim 10 and at least one selected from the group consisting of a charging device, a developing device, a transfer device, and a cleaning member.

18. An electrophotographic apparatus comprising:

the electrophotographic photosensitive member according to claim 10;

a charging device;

an exposing device;

a developing device; and a transfer device.

* * * * *